United States Patent [19]

Satoh et al.

[11] Patent Number: 4,861,390

[45] **Date of Patent: * Aug. 29, 1989**

[54] METHOD OF MANUFACTURING FORMABLE AS-ROLLED THIN STEEL SHEETS

[75] Inventors: Susumu Satoh; Saiji Matsuoka; Takashi Obara; Kozo Tsunoyama; Toshio Irie, all of Chiba, Japan

[73] Assignee: Kawasaki Steel Corporation, Kobe, Japan

[ * ] Notice: The portion of the term of this patent subsequent to Jun. 30, 2004 has been disclaimed.

[21] Appl. No.: 835,052

[22] Filed: Feb. 28, 1986

[30] Foreign Application Priority Data

| | | | |
|---|---|---|---|
| Mar. 6, 1985 | [JP] | Japan | 60-43971 |
| Mar. 6, 1985 | [JP] | Japan | 60-43972 |
| Mar. 6, 1985 | [JP] | Japan | 60-43973 |
| Mar. 6, 1985 | [JP] | Japan | 60-43974 |
| Mar. 6, 1985 | [JP] | Japan | 60-43975 |
| Mar. 6, 1985 | [JP] | Japan | 60-43976 |
| Mar. 6, 1985 | [JP] | Japan | 60-43977 |
| Mar. 6, 1985 | [JP] | Japan | 60-43978 |
| Mar. 6, 1985 | [JP] | Japan | 60-43979 |
| Mar. 6, 1985 | [JP] | Japan | 60-43980 |
| Mar. 6, 1985 | [JP] | Japan | 60-43981 |
| Mar. 6, 1985 | [JP] | Japan | 60-43982 |
| May 15, 1985 | [JP] | Japan | 60-101562 |

[51] Int. Cl.[4] ..... C21D 7/00

[52] U.S. Cl. ..... 148/12 R; 148/12 C; 148/12 D; 148/12.3

[58] Field of Search ..... 148/12 R, 12 B, 12 C, 148/12 D, 12.3

[56] References Cited

U.S. PATENT DOCUMENTS

| | | | |
|---|---|---|---|
| 4,589,931 | 5/1986 | Yasuda et al. | 148/12 D |
| 4,676,844 | 6/1987 | Satoh et al. | 148/12 C |

FOREIGN PATENT DOCUMENTS

| | | | |
|---|---|---|---|
| 1913171 | of 0000 | Fed. Rep. of Germany . | |
| 221233 | 12/1983 | Japan | 148/12 C |
| 226149 | 12/1984 | Japan | 148/12 C |
| 106920 | 6/1985 | Japan | 148/12 C |

OTHER PUBLICATIONS

Patent Abstracts of Japan, vol. 9, No. 104 (C-279) [1927] 8th May 1985; JP-A-59 229 413 (Shin Nippon Seitetsu K.K.) 22-12-1984.

Patent Abstracts of Japan, vol. 8 No. 232 (C-248) [1669], 25th Oct. 1984; & JP-A-59 113 121 (Shin Nippon Seitetsu K.K.) 7-31-84.

Patent Abstracts of Japan, vol. 8, No. 255 (C-253) [1692], 21st Nov. 1984; & JP-A-59 133 325 (Shin Nippon Seitetsu K.K.) 7/31/84.

W. L. Roberts: "Manufacturing Engineering and Materials Processing", vol. 2, Cold rolling of steel, 1978, pp. 296, 461-463, Marcel Dekker Inc., New York US *pp. 296, 461-463*.

*Primary Examiner*—L. Dewayne Rutledge
*Assistant Examiner*—George Wyszomierski
*Attorney, Agent, or Firm*—Balogh, Osann, Kramer, Dvorak, Genova & Traub

[57] ABSTRACT

A method of manufacturing formable as-rolled thin steel sheets having excellent ridging resistance and other properties is disclosed, which comprises rolling a low carbon steel to a given thickness without cold rolling and recrytallization annealing steps. In this rolling, at least one rolling pass is carried out within a given temperature range at high draft and high strain rate.

6 Claims, 12 Drawing Sheets

○ Steel A, Draft : 60%
△ Steel A, Draft : 40%
□ Steel A, Draft : 20%
● Steel B, Draft : 60%
▲ Steel B, Draft : 40%
■ Steel B, Draft : 20%

Draft

○ 20%
△ 40%
□ 60%
} Steel F

● 20%
▲ 40%
■ 60%
} Steel G

METHOD OF MANUFACTURING FORMABLE AS-ROLLED THIN STEEL SHEETS

BACKGROUND OF THE INVENTION

1. Field of the Invention

The invention relates to a method of manufacturing steel sheets by a rolling process so that the steel sheet so produced can be subjected to a forming process in the as-rolled condition.

2. Related Art Statement

Steel sheets of this general type having generally a relative thin thickness of not more than 2 mm, which are used in building materials, automobile components, various surface treating black plates and the like, are required to have the following properties:

(1) Mechanical Properties

In order to obtain good bending formability bulging formability and drawing formability, the steel sheet is mainly required to have high ductility and high Lankford value ($\bar{r}$-value). In this case, $\bar{r}$-value is represented by $\bar{r}=(r_L+r_C+2r_D)/4$, wherein $r_L$, $r_C$ and $r_D$ are r-values in a rolling direction (hereinafter abbreviated as L-direction), a direction perpendicular to L-direction (hereinafter abbreviated as C-direction) and a direction inclined at 45° with respect to L-direction (hereinafter abbreviated as D-direction), respectively.

In order to increase the yield of steel sheet during the forming process, the process known as bulging is often adopted because the flow of material from the blank holding portion can be reduced using the bulging forming process. In this case, it is required to have a high n-value (strain hardening exponent) as a property of the material.

Even if the formability in a particular direction is good, the actual forming is plane, so that when the planar anisotropy is large, folds are produced after the forming. On the other hand, when the anisotropy is small, the amount of earing cut after the forming becomes less to reduce the blank area, so that the yield of steel sheet is largely improved. Such an anisotropy as a mechanical property can be evaluated by $\Delta El$ (anisotropic parameter of elongation) and $\Delta r$ (anisotropic parameter of $\bar{r}$-value). Particularly, $\Delta El \leqq 5\%$ and $\Delta r \leqq 0.5$ are required as a steel having an improved anisotropy.

In the steel sheet of this type, a good balance of tensile strength and elongation is required because when the balance of tensile strength and elongation in poor, problems such as flange cracking and the like can be encountered during the forming process. A standard for providing a good balance of tensile strength (TS) and elongation (El) is approximately $TS(kg/mm^2) \times El(\%) \geqq 1{,}500$.

When the formable steel sheet is held at room temperature for a long period of time, the age deterioration may be caused to bring about the degradation of formability and hence cracking may be produced in the press forming. For this reason, the aging resistance is important, whose standard is AI (aging index) $\leqq 4(kg/mm^2)$.

In the steel sheet for automobile applications, the thickness of the sheet has been required to be reduced to improve fuel consumption of the vehicle. During the thinning of the sheet, a problem of reduction of tensile rigidity of the formed product is caused. For instance, when a force is applied externally to the formed product, deflection of the sheet is readily caused. Since the tensile rigidity of the steel sheet is proportional to Young's modulus, it can be enhanced by increasing the Young's modulus in the sheet plane. In this connection, the tensile rigidity is good when an average value ($\bar{E}$) of Young's moduli in L-direction, C-direction and D-direction is not less than 22,000 $kg/mm^2$. In this case, $\bar{E}$ is represented by $\bar{E}=(E_L+E_C+2E_D)/4$.

The automotive parts such as panel, oil pan, gasoline tank and the like are required to be severe in the formabilities, particularly deep drawability. For this end, the steel sheet used for such parts is required to have $\bar{r}$-value of not less than 1.7 though it is dependent upon the form of the respective part.

On the other hand, the steel sheet for use in outer panels of the automobile is required to have a low yield ratio (YR, %) represented by an equation of YR=(tensile strength/yield strength)×100, because when YR is low, it is possible to control planar strain in relatively light worked portions, for example, portion of a door outer near a handle. Further, there is a recent trend of enlarging the size of the panel for reducing the number of spot weld points and the like, and in this case the low YR is very effective for the press forming having a small planar strain.

(2) Surface Properties

Since the formable steel sheets are mainly used in outermost portions of final products, various surface treating properties are important in addition to the shape and surface appearance of the steel sheet.

Particularly, in the steel sheets for automobiles, the treatment prior to painting, phosphate coating is significant, becuase if the phosphate coating property is bad, sufficient baked-on painting property can not be ensured.

Further, the demand for the corrosion resistance of the formable thin steel sheet becomes more severe, while the use of surface treated steel sheet rapidly increases. Especially, the steel sheets for automobiles used in North Europe and North America should be durable to the corrosion due to the salt used for snow melting, which requires the more severe corrosion resistance. On the other hand, even when using the surface treated steel, if it is apt to be damaged in the forming, the corrosion resistance is deteriorated, so that the adhesion property between the base plate and the surface treated layer becomes very important in the surface treated steel sheet. Furthermore, since the formable steel sheet is used in the outermost portion of the final product as previously mentioned, the corrosion resistance of the steel sheet itself, particularly pitting resistance is important.

In general, the manufacture of such thin steel sheets is as follows:

At first, a low carbon steel is mainly used as a steel material, which is made into a slab sheet having a thickness of about 200 mm through ingot-making and slabbing. Then, the slab sheet is subjected to heating and soaking in a heating furnace and roughly hot rolled into a sheet bar having a thickness of about 30 mm. Next, the sheet bar is subjected to a final hot rolling at a temperature of higher than $Ar_3$ transformation point to form a hot rolled steel sheet with a given thickness, which is then pickled, cold rolled to form a cold rolled steel sheet with a given thickness (not more than 2.0 mm) and further subjected to recrystallization annealing to obtain a final product.

A great drawback of this customary process is very long in the steps required to produce the final product.

As a result, energy, labor and time required for the manufacture of the final product are vast, and also various troubles on the quality, particularly surface properties of the product are unfavorably caused through the long steps. For instance, there are unavoidable troubles such as occurrence of surface defects at the cold rolling step, concentration of impurity elements into sheet surface at the recrystallization annealing step, deterioration of appearance resulting from surface oxidation, degradation of surface treating property and so on.

As a method of manufacturing a formable thin steel sheet, it is also considered to provide a final product through only the hot rolling step. In such a method, the cold rolling step and recrystallization annealing step can be omitted, so that the industrial merits are large.

However, the mechanical properties of the thin steel sheet obtained only through the hot rolling step are fairly poor as compared with those obtained through the cold rolling-annealing steps. Although the press formable sheet used in the automotive vehicle body or the like is particularly required to have an excellent deep drawability, $\bar{r}$-value of the hot rolled steel sheet is as low as about 1.0 and consequently the application of the latter sheet is considerably restricted. Because, in the conventional hot rolling method, the final temperature is higher than $Ar_3$ transformation point so that the texture is randomized in the $\gamma \rightarrow \alpha$ transformation. Further, it is very difficult to manufacture a thin steel sheet with a thickness of not more than 2.0 mm through only the hot rolling step. In addition to the problem on the dimensional accuracy, the reduction of steel sheet temperature due to the thinning obliges the rolling of low carbon steel at a temperature below $Ar_3$ transformation point, resulting in the conspicuous deterioration of physical properties (ductility, drawability and the like). Even if the physical properties can be ensured by the rolling below $Ar_3$ transformation point, there is caused a new problem that the ridging is liable to occur in the steel sheet rolled at a temperature of ferrite region.

The term "ridging" used herein means an uneven defect produced on the surface of the product during the forming, which becomes fatal in this type of the steel sheet mainly used in the outermost portion of the formed article.

The ridging metallographically results from the fact that a group of crystal orientation not easily fractured even though rolling-recrystallization steps (for example, {100} orientation group) remains in the rolling direction as it is, which is generally liable to be produced at a relatively high temperature rolled state in a ferrite ($\alpha$) region. Particularly, this tendency is strong when the draft at the ferrite region is high or in case of manufacturing thin steel sheets.

Lately, the formable thin steel sheets are frequency subjected to more severe forming with the complication so that they are required to have an excellent ridging resistance.

The manufacturing steps for iron and steel materials are considerably varying, which also include the case of manufacturing formable thin steel sheets.

That is, the slabbing step may be omitted by the introduction of continuouly casting process. For the purpose of improving the physical properties and saving energy, the heating temperature of slab tends to reduce from about 1,200° C., which has been adopted in the prior art, to about 1,100° C. or less. Also, there is gradually practised a process capable of omitting the heat treatment in the hot rolling and the rough rolling step by directly producing a steel sheet with a thickness of not more than 50 mm from molten steel.

However, all of these new manufacturing steps are disadvantageous in case of breaking a texture produced in the solidification of molten steel (casting texture). Particularly, it is very difficult to break a strong casting texture consisting mainly of $\{100\}\langle uvw\rangle$ orientation formed in the solidification. As a result, the aforementioned ridging is apt to be caused in the final thin steel sheet.

In this connection, there have been proposed some methods of manufacturing formable thin steel sheets, wherein the slab sheet is directly shaped into a thin steel sheet with a given thickness at a relatively lower temperature region of less than $Ar_3$ transformation point and not subjected to subsequent cold rolling and recrystallization annealing steps. For example, Japanese Patent laid open No. 48-4,329 discloses that a low carbon rimmed steel is rolled into a steel sheet with a thickness of 4 mm at a temperature below $Ar_3$ transformation point and a draft of 90% to thereby provide a yield point of 26.1 kg/mm$^2$, a tensile strength of 37.3 kg/mm$^2$, an elongation of 49.7% and $\bar{r}$-value of 1.29. In Japanese Patent laid open No. 52-44,718 is disclosed a method of manufacturing low yield point steel sheet having an yield point of not more than 20 kg/mm$^2$ by hot rolling a low carbon rimmed steel to a thickess of 2.0 mm at a final temperature of 800°-860° C. (below $Ar_3$ transformation point) and coiling at a temperature of 600°-730° C. However, the resulting steel sheet has a conical cup value as an index for drawability of about 60.60-62.18 mm, which is equal or less in the drawability as compared with the conventionally known steel sheet having a conical cup valve of 60.58-60.61. Further, Japanese Patent laid open No. 53-22,850 discloses a method of manufacturing low carbon hot rolled steel sheet by hot rolling a low carbon rimmed steel to a thickness of 1.8-2.3 mm at a final temperature of 710°-750° C. and coiling at a temperature of 530°-600° C. However, the conical cup value of the resulting steel sheet is the same as in the aforementioned Japanese Patent laid open No. 52-44,718 and the drawability is poor. In Japanese Patent laid open No. 54-109,022 is disclosed a method of manufacturing low strength, mild steel sheets having a yield point of 14.9-18.8 kg/mm$^2$, a tensile strength of 27.7-29.8 kg/mm$^2$ and an elongation of 39.0-44.8% by hot rolling a low carbon aluminum killed steel to a thickness of 1.6 mm at a final temperature of 760°-820° C. and coiling at a temperature of 650°-690° C. In Japanese Patent laid open No. 59-226,149 is disclosed a method of manufacturing a thin steel sheet with $\bar{r}$-value of 1.21 by rolling a low carbon Al killed steel comprising 0.002% of C, 0.02% of Si, 0.23% of Mn, 0.009% of P, 0.008% of S, 0.025% of Al, 0.0021% of N and 0.10% of Ti to a thickness of 1.6 mm at 500°-900° C. and a draft of 76% while applying a lubricant oil.

SUMMARY OF THE INVENTION

It is, therefore, an object of the invention to provide a method of manufacturing thin steel sheets having improved ridging resistance and formability through a new process including no cold rolling and recrystallization annealing steps.

According to a first aspect of the invention, there is the provision of a method of manufacturing formable as-rolled thin steel sheets having an improved ridging resistance through a step of rolling a low carbon steel to a given thickness, which comprises performing at least one rolling pass within a temperature range of from 500° C. to $Ar_3$ transformation point at a draft of not less than 35% and a strain rate of not less than 300 $sec^{-1}$.

According to a second aspect of the invention, there is the provision of a method of manufacturing formable as-rolled thin steel sheets having improved ridging resistance and deep drawability through a step of rolling a low carbon steel to a given thickness, which comprises performing at least one rolling pass within a temperature range of from 300° C. to less than recrystallization temperature of ferrite at a draft of not less than 35% and a strain rate of not less than 300 $sec^{-1}$.

The preferred embodiments of the invention are as follows.

At first, the rolling pass is carried out under a condition of $\dot{\epsilon} \geqq 0.5T+80$ ($\dot{\epsilon}$: strain rate, T: rolling temperature, °C.) in order to improve the bulging formability of the thin steel sheet. In order to make the planar anisotropy small, the rolling pass is carried out under a condition of $\dot{\epsilon}/\mu \geqq 1{,}000$ ($\mu$: friction coefficient) or under a tension. Further, in order to improve the phosphate coating property, the coiling followed by the rolling is carried out at a temperature of not more than 400° C. And also, the rolling pass is carried out under a condition of $\dot{\epsilon}/R \geqq 2.0$ (R: radius of rolling roll) for improving the balance of tensile strength and elongation. In order to enhance the adhesion property, the thin steel sheet after the rolling is coiled at a temperature of not more than 400° C. and then subjected to hot metal dipping treatment or metal electroplating treatment. A steel material containing not less than 99.50% by weight of Fe is used as a low carbon steel for improving the corrosion resistance. In order to enhance the aging resistance, the thin steel after the coiling is held at a temperature of 200°–500° C. for at least one minute. Further, in order to reduce the yield ratio, the thin steel sheet after the rolling is heat treated at a temperature of not less than 500° C. for not less than 0.2 second. Moreover, in order to enhance the bulging rigidity, the rolling pass is carried out under a condition that the strain rate ($\dot{\epsilon}$) satisfies an equation (1) with respect to a critical strain rate ($\dot{\epsilon}_c$) represented by an equation (2):

$$0.5\dot{\epsilon}_c \leqq \dot{\epsilon} \leqq 1.5\dot{\epsilon}_c \quad (1)$$

$$\ln \dot{\epsilon}_c = -3{,}645/(273+T)+11.5 \quad (2)$$

DESCRIPTION OF THE PREFERRED EMBODIMENTS

The invention will be described with respect to experimental results leading the invention below.

Two test materials A and B are hot rolled steel sheets of low carbon aluminum killed steel having a chemical composition as shown in the following Table 1. Each of these test materials A and B was heated at 700° C., soaked and rolled at a draft of 20%, 40% or 60% at once.

TABLE 1

| Steel | C | Si | Mn | P | S | N | Al |
|---|---|---|---|---|---|---|---|
| A | 0.034 | 0.02 | 0.26 | 0.014 | 0.007 | 0.0038 | 0.046 |
| B | 0.002 | 0.01 | 0.18 | 0.009 | 0.005 | 0.0028 | 0.035 |

Figure 1:
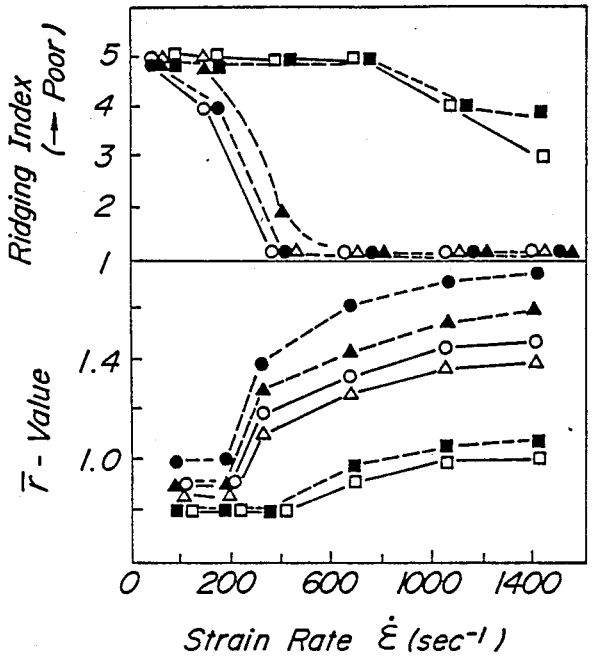
FIG. 1 is a graph showing an influence of strain rate on $\bar{r}$-value and ridging index taking a draft as a parameter.

In FIG. 1 is shown a relation of strain rate ($\dot{\epsilon}$) to $\bar{r}$-value and ridging index of the steel sheet after the rolling.

As seen from FIG. 1, the $\bar{r}$-value and ridging index are strongly dependent upon the strain rate and draft, and are considerably increased by performing the rolling at a draft of not less than 35% and a high strain rate of not less than 300 $sec^{-1}$.

The strain rate ($\dot{\epsilon}$) is calculated according to the following equation (3):

$$\dot{\epsilon} = \frac{2\pi n}{60\sqrt{r}} \cdot \sqrt{\frac{R}{H_0}} \cdot \ln\left(\frac{1}{1-r}\right) \quad (3)$$

, where n: a revolution number of a rolling roll (rpm);

r: draft (%)/100;

R: radius of a rolling roll (mm); and $H_0$: thickness before the rolling (mm).

Figure 2:
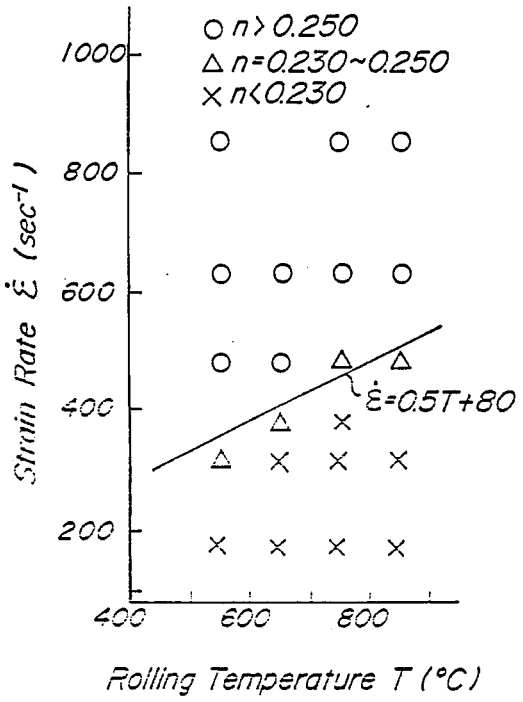
FIG. 2 is a graph showing a relation among n-value, strain rate and rolling temperature.

Further, when the as-rolled steel sheet (steel B) is further subjected to a skin pass of 1%, the influence of strain rate ($\dot{\epsilon}$) and rolling temperature (T, °C.) on n-value was examined to obtain a result as shown in FIG. 2.

As apparent from FIG. 2, when the strain rate and rolling temperature satisfy the following equation (4):

$$\dot{\epsilon} \geqq 0.5T+80 \quad (4)$$

, high n-value of 0.230 is obtained, from which it has been found to obtain a thin steel sheet having a very excellent bulging formability.

Figure 3:
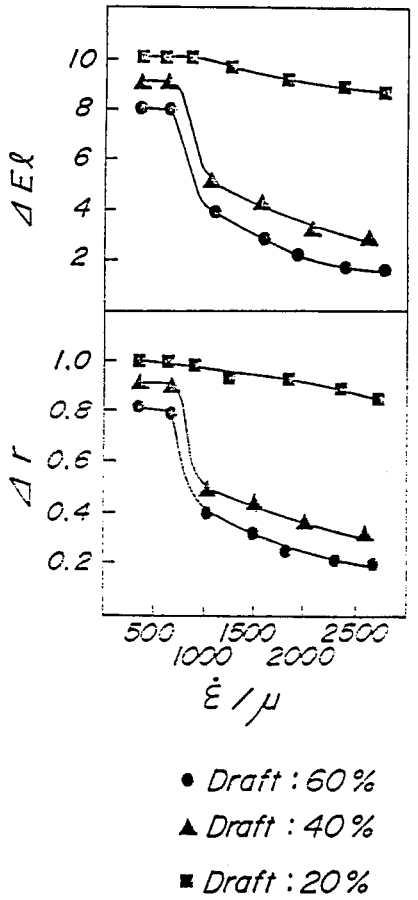
FIG. 3 is a graph showing a relation between strain rate and friction coefficient influencing planar anisotropy of $\bar{r}$-value and elongation and taking a draft as a parameter.

On the other hand, a relation of $\dot{\epsilon}/\mu$ ($\mu$: friction coefficient) to anisotropy of elongation and $\bar{r}$-value after the rolling was examined with respect to the test material B of Table 1 to obtain results as shown in FIG. 3. In this case, the friction coefficient was varied within a range of 0.6–0.06 by changing lubrication condition. The anisotropy was measured as $\Delta r=(r_L+r_C-2r_D)/2$ and $\Delta El=(El_L+El_C-2El_D)/2$, respectively.

As seen from FIG. 3, each of $\Delta r$ and $\Delta El$ rapidly reduces as the ratio $\dot{\epsilon}/\mu$ becomes not less than 1,000, whereby the planar anisotropy is considerably mitigated.

The following experiment was made with respect to a steel C having a chemical composition shown in the following Table 2 by using a rolling machine of 6 stands.

TABLE 2

| Steel | C | Si | Mn | P | S | N | Al |
|---|---|---|---|---|---|---|---|
| C | 0.002 | 0.01 | 0.18 | 0.008 | 0.007 | 0.0029 | 0.022 |

In this case, a tension of 3 kg/mm$^2$ was applied between 5 and 6 stands, and high strain rate, high draft rolling was carried out at the final stand. The final rolling temperature was 700° C.

Figure 4:
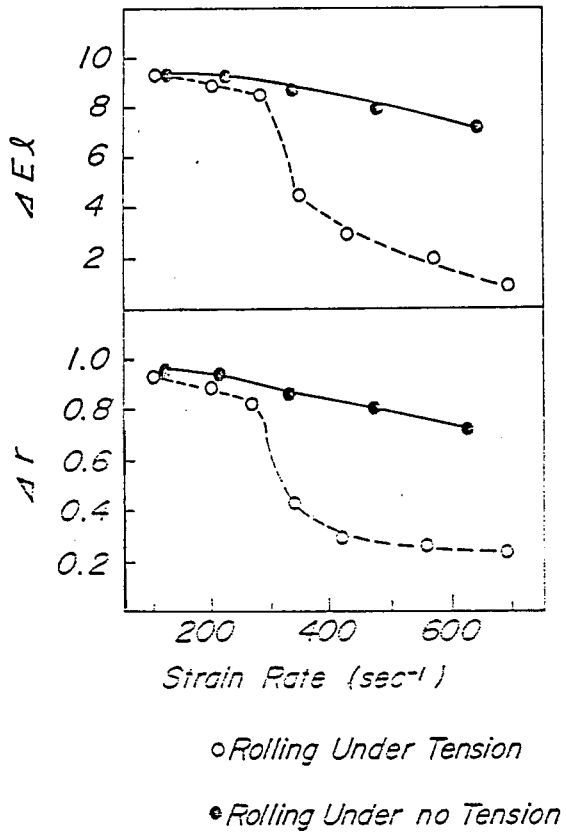
FIG. 4 is a graph showing an influence of strain rate and tension on anisotropy of $\bar{r}$-value and elongation.

In FIG. 4 is shown the planar anisotropy ($\Delta r$, $\Delta El$) of the resulting steel sheet after the rolling. As seen from FIG. 4, the planar anisotropy is considerably reduced by rolling under a tension at a strain rate of not less than 300 sec$^{-1}$.

Figure 5:
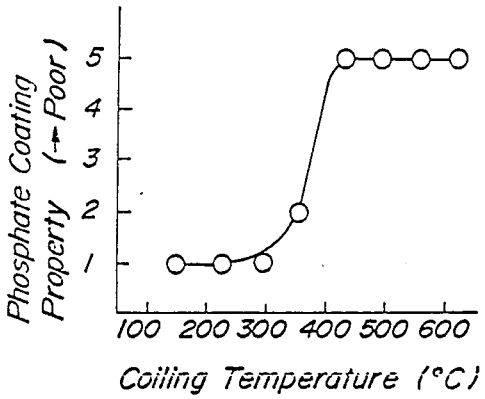
FIG. 5 is a graph showing an influence of coiling temperature on phosphate coating property.

The relation between the coiling temperature after the rolling and the phosphate coating property was examined with respect to a steel D having a chemical composition shown in the following Table 3 by means of a rolling machine of 6 stands to obtain results as shown in FIG. 5. In this case, the conditions of the final stand were a final rolling temperature of 700° C., a draft of 40% and a strain rate of 704 sec$^{-1}$.

TABLE 3

| Steel | C | Si | Mn | P | S | N | Al |
|---|---|---|---|---|---|---|---|
| D | 0.002 | 0.01 | 0.18 | 0.009 | 0.009 | 0.0028 | 0.028 |

As apparent from FIG. 5, the phosphate coating property is considerably improved by limiting the coiling temperature to not more than 400° C.

Moreover, the phosphate coating property was evaluated by subjecting the steel sheet to a phosphate treatment after degreasing and washing with water and then measuring an area ratio of pin hole through a pin hole test as mentioned later. The phosphate treatment was carried out by adjusting a solution of BT3112 made by Nippon Parkerizing K.K. to a total acid value of 14.3 and a free acid value of 0.5 and then spraying it onto the steel sheet for 120 seconds.

Pin hole test:

A filter paper impregnated with a reagent developing a color by reaction with iron ion is closely contacted with the surface of the treated steel sheet to be tested and then taken out therefrom to detect nonadhered portion of phosphate crystal remaining on the steel sheet surface, from which the area ratio of pin hole is measured as a numerical value by image analysis. The evaluation standard for the phosphate coating property is made into 1 corresponding to the area ratio of pin hole of less than 0.5%, 2 corresponding to 0.5–2.0%, 3 corresponding to 2–9%, 4 corresponding to 9–15% and 5 corresponding to more than 15%. Numerical values of 1 and 2 indicate the area ratio of pin hole causing no trouble in practice.

Figure 6:
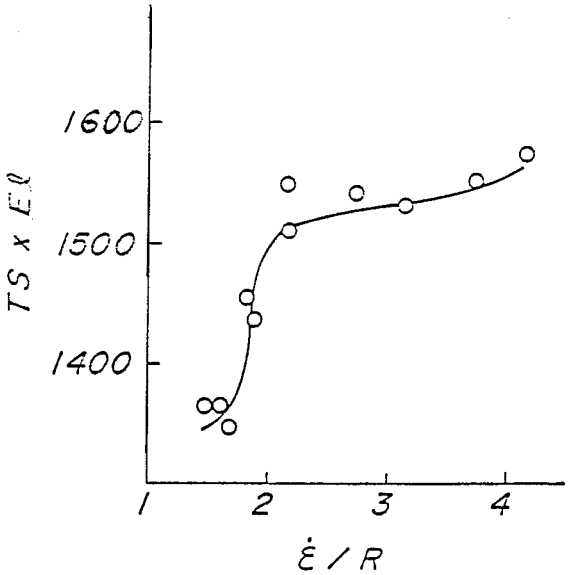
FIG. 6 is a graph showing an influence of $\dot{\epsilon}/R$ on balance of tensile strength and elongation.

The relation of $\dot{\epsilon}/R$ exerting on the balance ($TS\times El$) of tensile strength and elongation in the as-rolled thin steel sheet was examined with respect to the steel B of Table 1 to obtain results as shown in FIG. 6.

As seen from FIG. 6, the excellent balance of $TS\times El\geqq 1{,}500$ is obtained when $\dot{\epsilon}/R$ is not less than 2.0.

A steel E having a chemical composition shown in the following Table 4 was shaped into a sheet bar with a thickness of 25 mm through continuous casting and rough rolling, which was rolled to a thickness of 1.2 mm by means of a rolling machine of 6 stands, wherein the rolling at the final stand was carried out at a high strain rate (562 sec$^{-1}$) and a final temperature of 670° C.

TABLE 4

| Steel | C | Si | Mn | P | S | N | Al |
|---|---|---|---|---|---|---|---|
| E | 0.002 | 0.01 | 0.16 | 0.009 | 0.005 | 0.0019 | 0.022 |

The resulting thin steel sheet was coiled at various coiling temperatures, heated in a continuous hot zinc dipping line to a temperature required for the dipping (for example, 600° C. Zn for dipping) without pickling and recrystallization treatment, and continuously subjected to a hot zinc dipping treatment. The test results on zinc dipped adhesion property to the thin steel sheet are shown in FIG. 7.

In the bending test, the adhesion property was judged by a critical peeling value when the dipped sheet is subjected to a bending of from bending radius 0T (adhesion bending) to bending radius 4T corresponding to two times of the sheet thickness. Further, the critical peeling value in the bulging formation was simultaneously measured by using an Erichsen testing machine.

Figure 7:
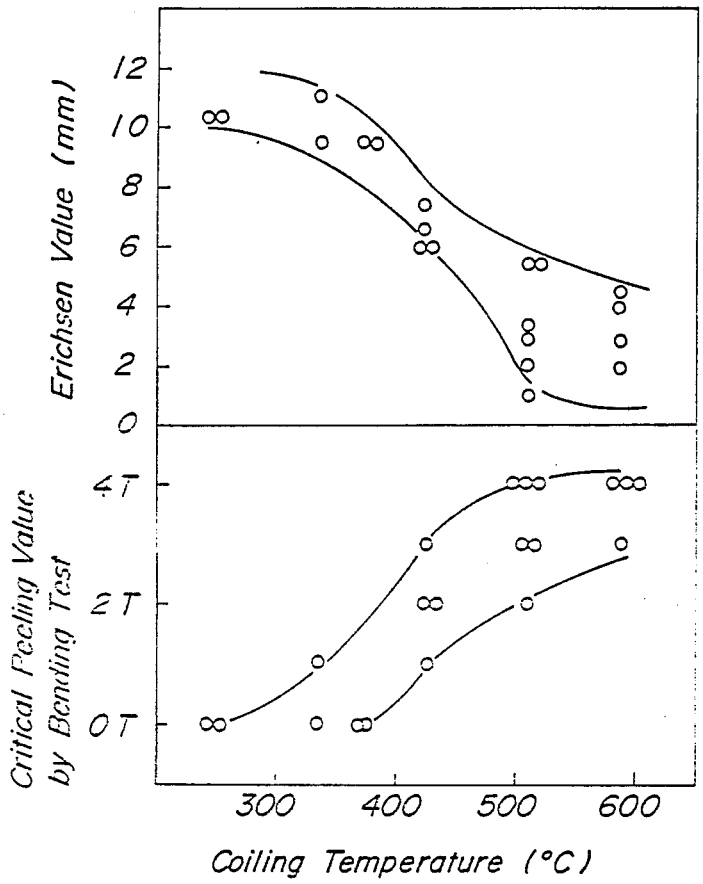
FIG. 7 is a graph showing an influence of coiling temperature on adhesion property of dipped layer.

It is apparent from FIG. 7 that the adhesion property and Erichsen value become excellent by limiting the coiling temperature to not more than 400° C.

A low carbon aluminum killed steel having a chemical composition shown in the following Table 5 was heated and soaked at 450° C., and then rolled at a draft of 20%, 40% or 60% at once.

TABLE 5

| Steel | C | Si | Mn | P | S | Al | N | Recrystallization temperature (°C.) |
|---|---|---|---|---|---|---|---|---|
| F | 0.022 | 0.01 | 0.26 | 0.008 | 0.004 | 0.026 | 0.0031 | 530 |
| G | 0.002 | 0.01 | 0.16 | 0.009 | 0.002 | 0.012 | 0.0017 | 485 |

Figure 8:
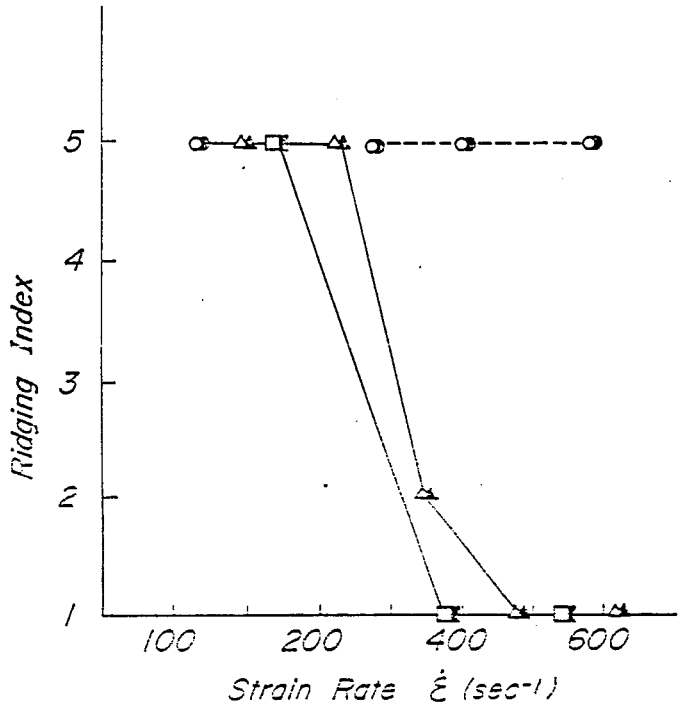
FIG. 8 is a graph showing an influence of strain rate on ridging index taking a draft as a parameter.

In this case, the relation between the strain rate and the ridging index of the steel sheet after the rolling was examined to obtain results as shown in FIG. 8.

As seen from FIG. 8, the ridging index is strongly dependent upon the strain rate and draft, and is considerably enhanced when the rolling is carried out at a high draft of 40% or 60% and a high strain rate of not less than 300 sec$^{-1}$.

Figure 9:
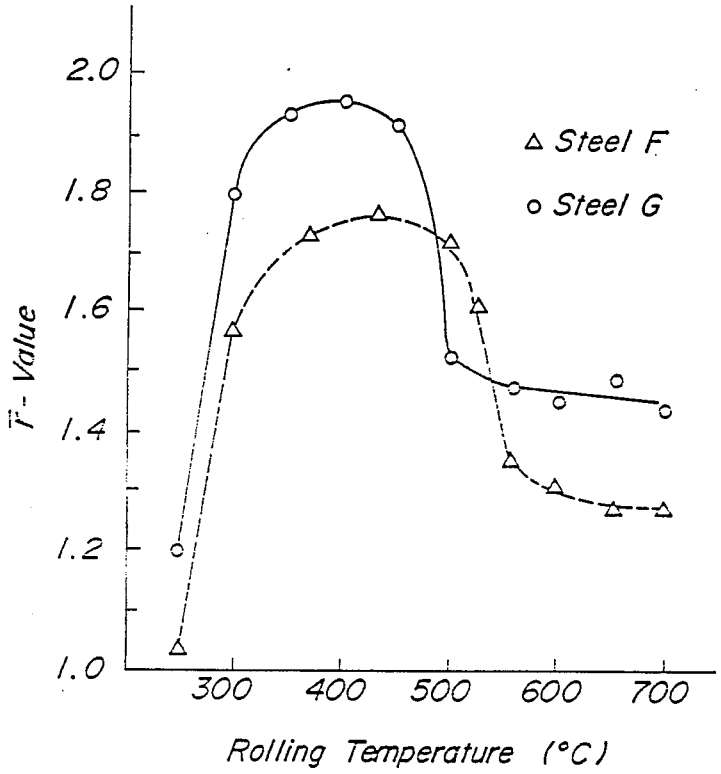
FIG. 9 is a graph showing a relation between rolling temperature and $\bar{r}$-value.

The $\bar{r}$-value of the rolled steel sheet was further measured with respect to the steels F and G of Table 5 by changing the rolling temperature to obtain results as shown in FIG. 9. In this case, the strain rate was 825 sec$^{-1}$ and the draft was 65%. Moreover, the recrystallization temperature of ferrite in the steels F and G was shown in Table 5, which was determined from the changes of hardness and texture when the steel sheet was cold rolled at room temperature at a reduction rate of 75% and then heated at a rate of 20° C./hr.

As seen from FIG. 9, the $\bar{r}$-value rapidly increases when each steel is rolled at a temperature below recrystallization temperature. In the rolling at a temperature below about 300° C., however, the recrystallization is not caused at the as-rolled state and hence the $\bar{r}$-value rapidly lowers.

Then, the corrosion resistance was examined with respect to thin steel sheets obtained by rolling steel of various chemical compositions at high strain rate and high draft. In this case, the corrosion resistance was evaluated by corrosion weight loss and corrosion hole number when the steel sheet of 0.8 mm in thickness to be tested was subjected to a salt spray test for 2,250 hours after the degreasing treatment.

Figure 10:
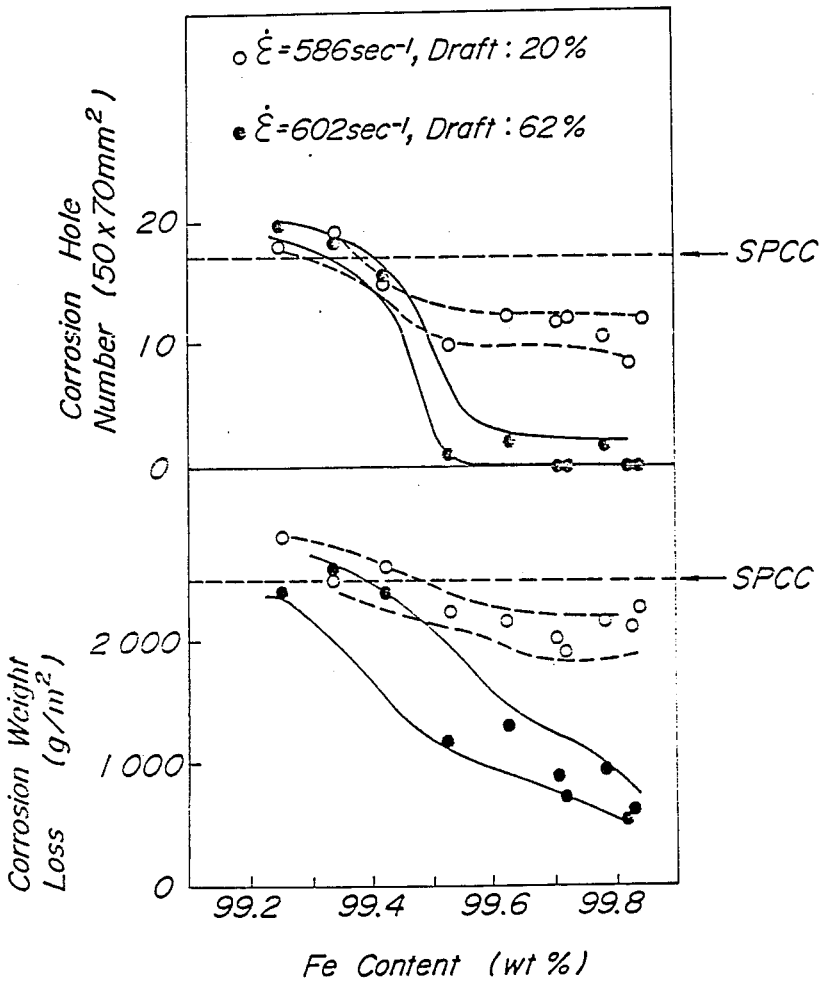
FIG. 10 is a graph showing a relation between Fe content of steel material and corrosion resistance.

The thus obtained results are shown in FIG. 10 as a relation to Fe content. For the comparison, the level of corrosion resistance in the commerically available cold rolled steel sheet (SPCC, made by the well-known process) is also shown in FIG. 10.

As apparent from FIG. 10, the better corrosion resistance is obtained when the steel having an Fe content of not less than 99.5% is rolled at high strain rate and high draft.

Figure 11:
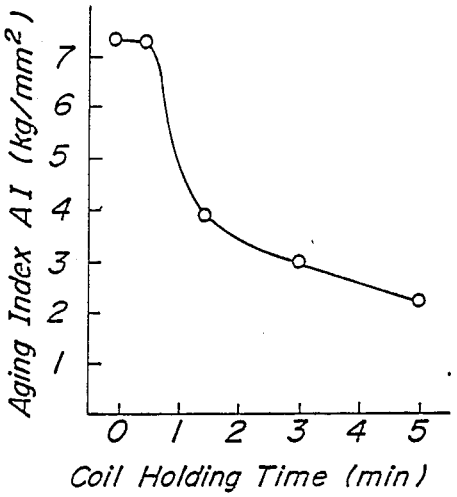
FIG. 11 is a graph showing an influence of coil holding time on AI.

When a steel H having a chemical composition shown in the following Table 6 was rolled in a rolling machine of 6 stands and then coiled at a temperature of 430° C., the relation between the coil holding time after the rolling and the aging index (AI) was examined to obtain results as shown in FIG. 11. In this case, the rolling at the final stand was carried out at a final temperature of 700° C. and a high strain rate of 400 $sec^{-1}$ and a high draft.

TABLE 6

| Steel | C | Si | Mn | P | S | N | Al |
|---|---|---|---|---|---|---|---|
| H | 0.02 | 0.01 | 0.28 | 0.009 | 0.009 | 0.0038 | 0.043 |

As seen from FIG. 11, the aging index of the steel held at the coiled state for more than 1 minute considerably reduces as compared with that of the steel sheet decoiled within 1 minute. Moreover, the aging index was evaluated by an increment of yield strength when the steel sheet was previously tensioned under a strain of 7.5% and subjected to a heat treatment at 100° C. for 30 minutes.

Figure 12:
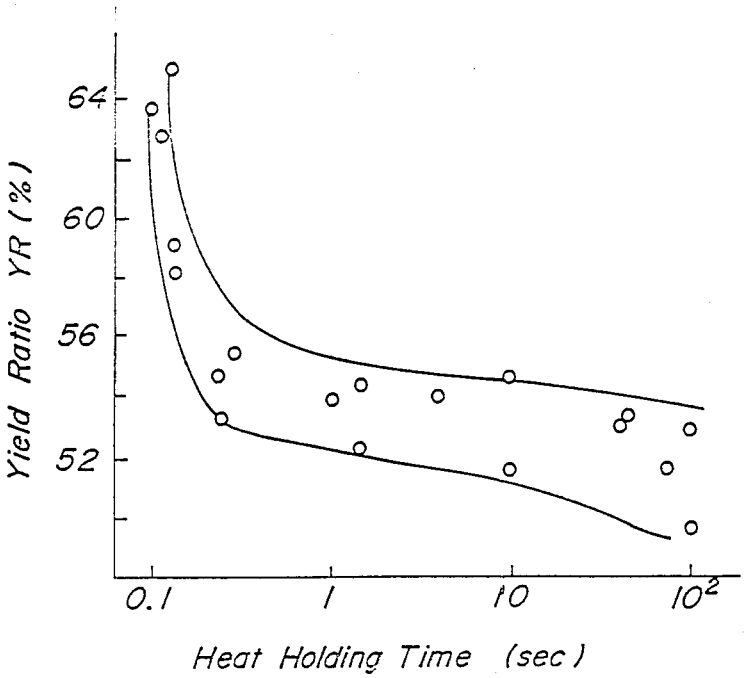
FIG. 12 is a graph showing a relation between YR and heat holding time at 600° C. for the rolling.

Next, when the steel B of Table 1 is heated and soaked at 650° C. and rolled at a draft of 60% and $\dot{\epsilon}=1{,}042$ $sec^{-1}$ at once and continuously passed through a furnace heated to 600° C., the relation between the heat holding time and the yield ratio (YR) was examined to obtain results as shown in FIG. 12. As apparent from FIG. 12, YR of not more than 55% is obtained by heating the steel sheet for the holding time of not less than 0.2 second.

A steel I having a chemical composition shown in the following Table 7 was shaped into a sheet bar of 25 mm in thickness through continuous casting and rough rolling steps, and then rolled to a thickness of 1.2 mm by using a rolling machine of 6 stands, wherein the rolling at the final stand was carried out at a high strain rate of 582 $sec^{-1}$ and a final temperature of 670° C.

TABLE 7

| Steel | C | Si | Mn | P | S | N | Al |
|---|---|---|---|---|---|---|---|
| I | 0.002 | 0.01 | 0.19 | 0.009 | 0.008 | 0.0029 | 0.042 |

Figure 13:
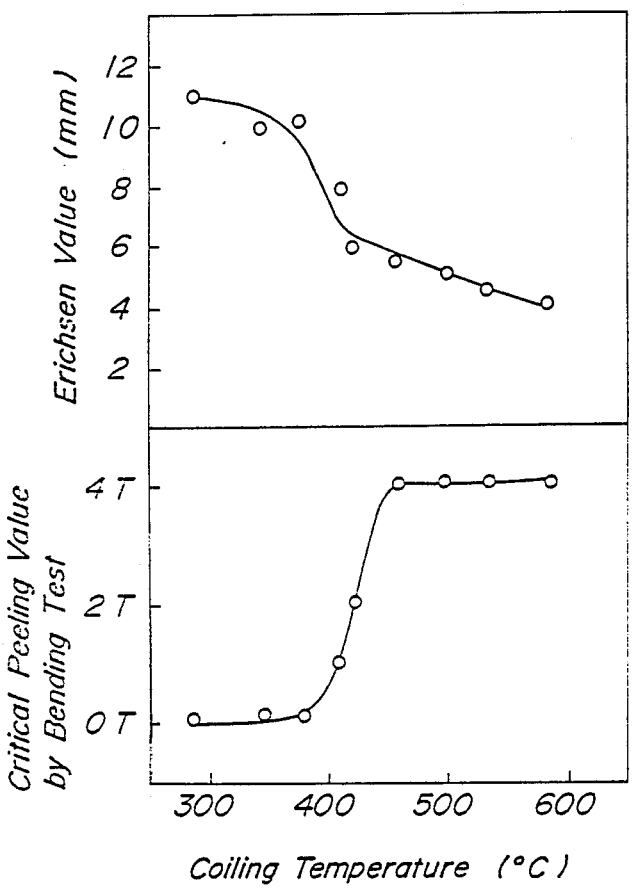
FIG. 13 is a graph showing an influence of coiling temperature on adhesion property of plated layer.

The resulting steel sheet was coiled at various coiling temperatures and then continuously subjected to a plating treatment in a zinc electroplating line without pickling. The test results on the adhesion property of the zinc plated steel sheet are shown in FIG. 13. The adhesion property was evaluated by the critical peeling value in bending test and the Erichsen value as previously mentioned.

It is apparent from FIG. 13 that the excellent adhesion property is obtained when the coiling temperature is not more than 400° C.

Figure 14:
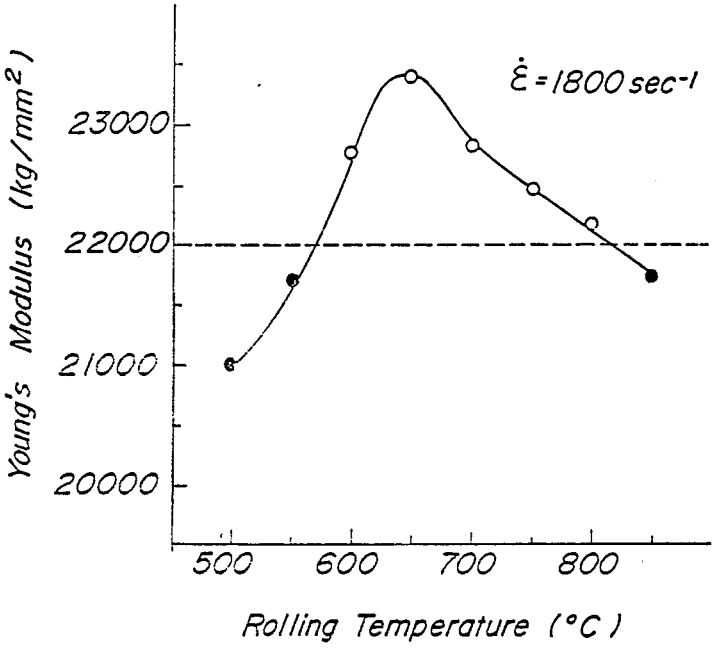
FIG. 14 is a graph showing an influence of rolling temperature on Young's modulus.

Then, when the steel B of Table 1 was heated at 500°–850° C. and then rolled at a draft of 60% and a strain rate of 1,800 $sec^{-1}$ at once, the relation between the rolling temperature and the Young's modulus was examined to obtain results as shown in FIG. 14. The Young's modulus ($\bar{E}$) becomes peaky at 650° C., and is not less than 22,000 $kg/mm^2$ within a range of 600°–800° C.

Figure 15:
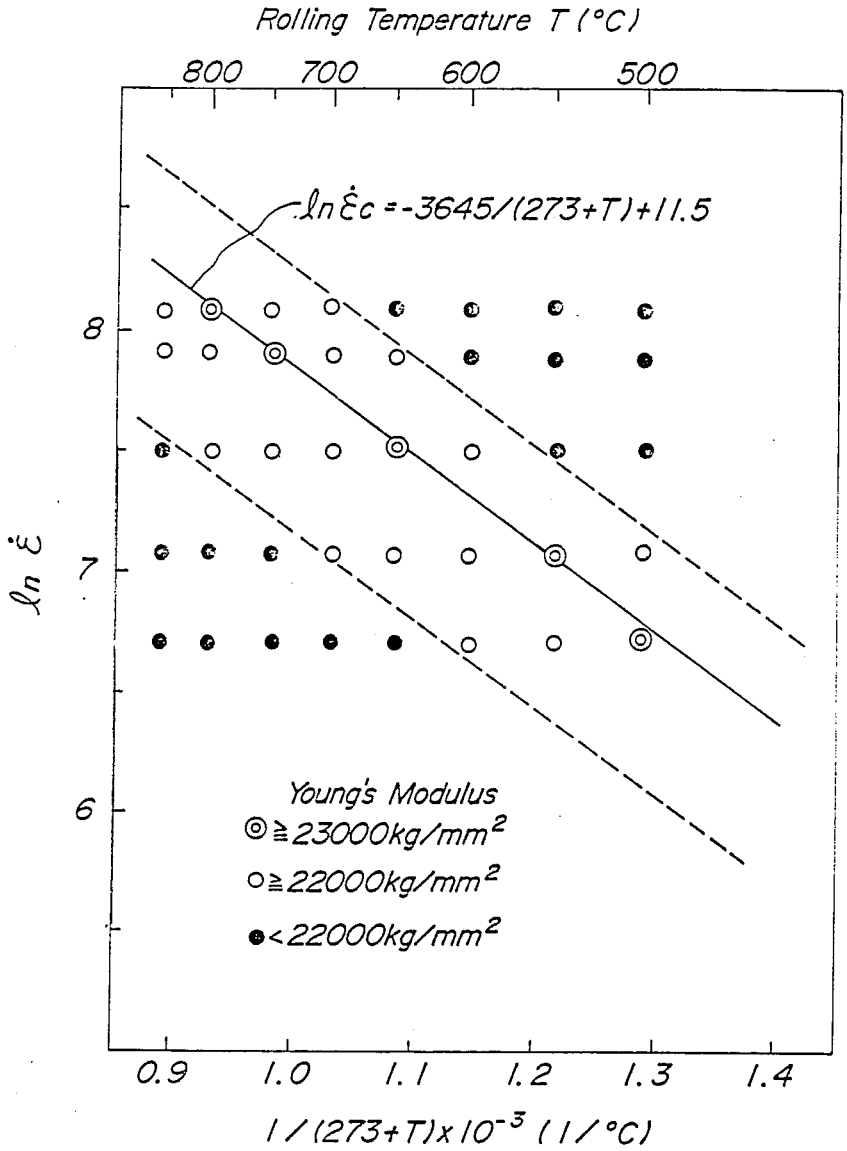
FIG. 15 is a graph showing an influence of rolling temperature and strain rate on Young's modulus.

Further, the relation between the critical strain rate ($\dot{\epsilon}_c$) and the rolling temperature (T), which exerts on the Young's modulus when changing the strain rate, was examined to obtain results as shown in FIG. 15. As seen from FIG. 15, the Young's modulus with respect to $\dot{\epsilon}_c$ satisfying $\ln \dot{\epsilon}_c = -3{,}645/(273+T)+11.5$ is not less than 23,000 $kg/mm^2$ and may be not less than 22,000 $kg/mm^2$ within a range of $0.5\dot{\epsilon}_c \leqq \dot{\epsilon} \leqq 1.5\dot{\epsilon}_c$.

The inventors have made studies with respect to the above basic data and confirmed that the as-rolled thin steel sheets having excellent ridging resistance and formability as well as other properties can be manufactured by controlling the manufacturing conditions as mentioned later.

(1) Chemical composition of steel

The effect by high strain rate rolling is not substantially dependent upon the chemical composition of steel material. However, in order to ensure the formability above a certain level, it is preferable that the amounts of C and N as an interstitial solid solution element are limited to not more than 0.10% and not more than 0.01%, respectively. Further, the feature that the amount of O in steel is reduced by the addition of Al is effective for improving the physical properties, particularly ductility. In order to obtain more excellent formability, it is effective to add an element capable of precipitating and fixing C and N as stable carbide and nitride such as Ti, Nb, Zr, B and the like. If necessary, P, Si, Mn and the like may be added for obtaining higher tensile strength.

In order to obtain excellent formability and corrosion resistance, the steel is required to have an Fe content of not less than 99.50%, preferably not less than 99.70% When the Fe content is within the above range, the kind and amount of inevitable impurity are substantially out of the question, and the addition of trace amounts of Al for deoxidation and Nb, Ti or the like for formation of carbide or nitride is advantageous for the improvement of physical properties.

(2) Production process of steel material for rolling

According to the invention, slabs obtained by the conventional system, for example, ingot making-slabbing process or continuous casting process are naturally applicable. The heating temperature of the slab is suitable within a range of 800°–1,250° C. and is preferable to be less than 1,100° C. from a viewpoint of energy-saving.

Of course, a so-called CC-DR (continuous casting-direct rolling) process, wherein the continuously cast slab is rolled without reheating, is applicable.

On the other hand, a process of directly producing a rolling steel material of not more than 50 mm in thickness from molten steel (sheet bar caster process, strip caster process and the like) is large in the economical merit from viewpoints of energy-saving and step-saving, and is particularly advantageous as a production process of the rolling steel material.

(3) Rolling step

According to the invention, the rolling step is most important. That is, it is essential that when rolling a low carbon steel to a given thickness (0.6–2 mm), at least one rolling pass is performed within a temperature range of from 500° C. to $Ar_3$ transformation point at a draft of not less than 35% and a strain rate ($\dot{\epsilon}$) of not less than 300 $sec^{-1}$.

When the final rolling temperature exceeds $Ar_3$ transformation point, if the rolling is carried out at a draft of not less than 35% and a strain rate of not less than 300 $sec^{-1}$, only as-rolled thin steel sheets having poor formability and ridging resistance are obtained, while when it is less than 500° C., the deformation resistance is considerably increased to cause troubles inherent in the cold rolling process, so that the final rolling temperature is restricted to a range of from 500° C. to $Ar_3$ transformation point.

As to the strain rate ($\dot{\epsilon}$), when $\dot{\epsilon}$ is less than 300 $sec^{-1}$, the given physical properties can not be obtained, so that $\dot{\epsilon}$ is preferably to be not less than 300 $sec^{-1}$, more particularly 500–2,500 $sec^{-1}$.

In order to obtain a good n-value of $n \geqq 0.23$, the strain rate ($\dot{\epsilon}$) and rolling temperature are important to satisfy a relation of $\dot{\epsilon} \geqq 0.5T + 80$ as seen from the results of FIG. 2.

In order to make the planar anisotropy small, it is necessary that the strain rate ($\dot{\epsilon}$) and friction coefficient ($\mu$) satisfy a relation of $\dot{\epsilon}/\mu \geqq 1{,}000$ as seen from the results of FIG. 3 or a tension is applied in the rolling as seen from the results of FIG. 4. In the latter case, it is favorable to apply a tension of not less than 1 $kg/mm^2$.

In order to obtain an excellent balance of tensile strength and elongation, it is important to satisfy a relation of $\dot{\epsilon}/R \geqq 2.0$ (where R is a radius of a rolling roll) as shown in FIG. 6.

According to the second aspect of the invention, when the final rolling temperature is not less than the ferrite recrystallization temperature or is less than 300° C., if the rolling is carried out at a draft of not less than 35% and a strain rate of not less than 300 $sec^{-1}$, the deep drawability is poor as shown in FIG. 9, so that the final rolling temperature is limited to a range of from 300° C. to less than ferrite recrystallization temperature.

And also, it is important that the rolling pass is carried out under a condition that the strain rate ($\dot{\epsilon}$) satisfies an equation (1) with respect to a critical strain rate ($\dot{\epsilon}_c$) represented by an equation (2):

$$0.5\dot{\epsilon}_c \leqq \dot{\epsilon} \leqq 1.5\dot{\epsilon}_c \quad (1)$$

$$\ln\dot{\epsilon}_c = -3{,}645/(273+T) + 11.5 \quad (2)$$

in order to improve the bulging rigidity. The critical strain rate ($\dot{\epsilon}_c$) is dependent upon the rolling temperature and strain rate and is a value capable of giving Young's modulus of not less than 23,000 $kg/mm^2$ to an as-rolled product. The above equation (2) is determined from the expriments of FIG. 15 and represented as a factor of the rolling temperature (T).

The arrangement and structure of the rolling machine, the number of rolling passes and the distribution of the draft may be optional when the above mentioned rolling conditions are satisfied in the invention.

As to the coiling temperature, it should be limited to not more than 400° C., because when it exceeds 400° C., the degradation of the phosphate coating property is conspicuous and sufficient adhesion property is not obtained as shown in FIGS. 5, 7 and 13.

The heat treatment of the as-rolled steel sheet may be carried out by the control of cooling or by heating in a heating furnace, a heating roll or the like. In this case, it is desired to hold the as-rolled steel sheet at a heating temperature of not less than 500° C. for a time of not less than 0.2 second. Moreover, when the coiling temperature exceeds 500° C. or is less than 200° C., the precipitation of $Fe_3C$ useful for the improvement of aging resistance is insufficient, while when the coil holding time is less than 1 minute, the effect reducing AI is poor. Therefore, it is desirable that the coiling after the rolling is held at a temperature of 200°–500° C. for a time of not less than 1 minute.

According to the invention, the recrystallization annealing treatment is not required in principle. From demands on the physical properties, however, it may be performed that the as-rolled steel sheet is subjected to a heat holding or soaking treatment at the runout table and coiling step after the rolling or subjected to a somewhat heating treatment after the rolling.

(4) Pickling, skin-pass rolling

Since the resulting as-rolled steel sheets are manufactured by the rolling at a temperature region lower than that of the prior art, the oxide layer is fairly thin and the pickling property is very good, so that they can widely be used for applications without pickling. Further, the descaling may be performed by the removal with an acid or the mechanical removal as in the prior art. Moreover, the skin-pass rolling of not more than 10% may be applied for the correction of shape and the adjustment of surface roughness.

(5) Surface treatment

The thus obtained steel sheets are excellent in the surface treating properties such as zinc dipping property (inclusive of zinc alloys), tin dipping property, enameling property and the like, so that they are applicable as a black plate for various surface treatments. And also, they are excellent in the metal electroplating adhesion property. Since the kind, adhered amount and the like of the plating layer are not essential, the steel sheets are applicable to Zn electroplating, Zn alloy electroplating, Sn electroplating and other electroplating processes.

Although the reason why the ridging resistance and $\bar{r}$-value as well as other properties are considerably improved by the rolling at high draft and high strain rate according to the invention is not yet clear, it is considered that the improvement of these properties is closely related to the change in texture formation of the rolling material and the change in forming strain in rolling. Further, the reason for providing thin steel sheets having an excellent corrosion resistance is considered to be due to the fact that the combination of high purity steel with the rolling at high draft and high strain rate brings about the homogenization of crystal texture.

The following examples are in illustration of the invention and are not intended as limitation thereof.

In each example, the evaluations on the properties of the thin steel sheet were performed by the method as previously mentioned, unless otherwise specified. Moreover, the tensile properties were measured by using a JIS No. 5 specimen. The ridging property was evaluated by 1(good)-5(poor) according to visual method on the surface unevenness when a tensile strain of 15% is previously applied to a JIS No. 5 specimen cut out from the rolling direction. A standard of the evaluation is not yet established in the manufacture of the conventional low carbon cold rolled steel sheet because the ridging is not actually observed. Therefore, in the invention, the index evaluation standard by visual method on the conventional stainless steel is adopted as it is. The evaluation value of 1 and 2 shows the ridging property having no problem in practice.

EXAMPLE 1

Each steel having a chemical composition as shown in the following Table 8 was shaped into a sheet bar of 20–40 mm in thickness by a method shown in the following Table 9, which was then shaped into a thin steel sheet of 0.8–1.2 mm in thickness by means of a rolling machine of 6 stands. In this case, the high rate rolling was carried out at the final stand.

The thus obtained thin steel sheet was subjected to pickling and skin-pass rolling (draft: 0.5–1%) to obtain properties as shown in Table 9.

TABLE 8

| Steel | C | Si | Mn | P | S | N | Al | Others |
|---|---|---|---|---|---|---|---|---|
| 1 | 0.034 | 0.01 | 0.27 | 0.008 | 0.015 | 0.0040 | 0.045 | |
| 2 | 0.040 | 0.02 | 0.25 | 0.010 | 0.009 | 0.0032 | 0.040 | B: 0.0028 |
| 3 | 0.001 | 0.01 | 0.19 | 0.006 | 0.008 | 0.0026 | 0.035 | |
| 4 | 0.003 | 0.02 | 0.16 | 0.011 | 0.002 | 0.0019 | 0.028 | Ti: 0.034 |
| 5 | 0.002 | 0.01 | 0.18 | 0.008 | 0.006 | 0.0020 | 0.019 | Nb: 0.015 |
| 6 | 0.002 | 0.01 | 0.20 | 0.010 | 0.006 | 0.0023 | 0.020 | Ti: 0.025<br>Nb: 0.005 |

TABLE 9

| Steel | Production of sheet bar | Thickness (mm) | Rolling conditions: strain rate ($sec^{-1}$) | draft (%) | final temperature (°C.) | Properties: YS ($kg/mm^2$) | TS ($kg/mm^2$) | El (%) | $\bar{r}$ | ridging index | |
|---|---|---|---|---|---|---|---|---|---|---|---|
| 1 | Rough rolling | 1.0 | 385 | 36 | 712 | 20 | 33 | 45 | 1.20 | 2 | |
| 2 | " | 1.2 | 580 | 39 | 798 | 22 | 34 | 44 | 1.36 | 1 | |
| " | " | 1.0 | 245 | 38 | 802 | 20 | 33 | 42 | 0.98 | 4 | * |
| " | Sheet bar caster | 1.2 | 512 | 52 | 598 | 24 | 33 | 45 | 1.39 | 1 | |
| 3 | " | 1.0 | 534 | 36 | 756 | 16 | 28 | 51 | 1.45 | 2 | |
| " | Rough rolling | 0.8 | 568 | 41 | 663 | 17 | 29 | 50 | 1.48 | 1 | |
| " | " | 1.2 | 573 | 28 | 650 | 17 | 29 | 47 | 1.02 | 5 | * |
| " | " | 1.2 | 1,261 | 68 | 504 | 16 | 29 | 51 | 1.69 | 1 | |
| 4 | " | 0.8 | 262 | 52 | 565 | 18 | 30 | 48 | 1.08 | 5 | * |
| " | " | 1.2 | 1,025 | 53 | 743 | 17 | 30 | 51 | 1.53 | 1 | |
| " | " | 1.0 | 734 | 39 | 823 | 16 | 28 | 52 | 1.40 | 1 | |
| " | Sheet bar caster | 1.2 | 1,653 | 38 | 682 | 18 | 30 | 51 | 1.58 | 1 | |
| 5 | Sheet bar caster | 1.0 | 503 | 36 | 905 | 17 | 30 | 46 | 1.03 | 4 | * |
| " | " | 0.8 | 564 | 39 | 729 | 18 | 29 | 51 | 1.48 | 1 | |
| " | Rough rolling | 1.0 | 439 | 56 | 539 | 17 | 28 | 51 | 1.53 | 1 | |
| " | " | 1.2 | 539 | 22 | 633 | 17 | 30 | 48 | 1.09 | 5 | * |
| 6 | " | 1.2 | 403 | 48 | 776 | 16 | 28 | 52 | 1.49 | 1 | |
| " | " | 0.8 | 1,856 | 37 | 755 | 17 | 30 | 51 | 1.53 | 1 | |
| " | " | 1.0 | 252 | 42 | 815 | 18 | 30 | 47 | 1.01 | 5 | * |
| " | Sheet bar caster | 1.2 | 654 | 72 | 653 | 18 | 29 | 50 | 1.68 | 1 | |

Note
*Comparative example,
no mark: acceptable example

As apparent from Table 9, the steel sheets according to the invention shown excellent $\bar{r}$-value and ridging resistance as compared with the comparative examples, which are equal to those obtained through the conventional cold rolling-recrystallization annealing steps.

EXAMPLE 2

Each of steels having a chemical composition as shown in the following Table 10 was shaped into a sheet bar of 20–40 mm in thickness by a method shown in the following Table 11, which was then shaped into a thin steel sheet of 0.8–1.2 mm in thickness by means of a rolling machine of 6 stands. In this case, the high strain rate rolling was carried out at the final stand.

The thus obtained thin steel sheet was subjected to pickling and skin-pass rolling (draft: 0.5–1%) to obtain properties as shown in Table 11.

TABLE 10

| Steel | C | Si | Mn | P | S | N | Al | Others |
|---|---|---|---|---|---|---|---|---|
| 7 | 0.018 | 0.02 | 0.26 | 0.009 | 0.008 | 0.0032 | 0.050 | |
| 8 | 0.003 | 0.01 | 0.17 | 0.012 | 0.005 | 0.0026 | 0.036 | Nb: 0.015 |
| 9 | 0.001 | 0.02 | 0.16 | 0.006 | 0.002 | 0.0022 | 0.016 | Ti: 0.020<br>B: 0.0008 |

TABLE 11

| Steel | Production of sheet bar | Thickness (mm) | Rolling conditions: strain rate ($sec^{-1}$) | draft (%) | final temperature (°C.) | Application to formula (1) | Properties: YS ($kg/mm^2$) | TS ($kg/mm^2$) | El (%) | $\bar{r}$ | n value | ridging index | |
|---|---|---|---|---|---|---|---|---|---|---|---|---|---|
| 7 | Rough rolling | 1.0 | 258 | 26 | 720 | unacceptable | 21 | 31 | 46 | 0.80 | 0.205 | 5 | * |
| " | " | 1.0 | 360 | 40 | 730 | unacceptable | 20 | 31 | 47 | 1.18 | 0.208 | 2 | * |
| " | " | 1.0 | 601 | 42 | 740 | acceptable | 19 | 30 | 49 | 1.30 | 0.239 | 1 | |
| 8 | " | 1.2 | 306 | 56 | 530 | unacceptable | 18 | 31 | 46 | 1.26 | 0.216 | 2 | * |
| " | " | 1.2 | 723 | 55 | 560 | acceptable | 17 | 30 | 48 | 1.55 | 0.260 | 1 | |

TABLE 11-continued

| Steel | Production of sheet bar | Thickness (mm) | Rolling conditions: strain rate ($sec^{-1}$) | draft (%) | final temperature (°C.) | Application to formula (1) | Properties: YS ($kg/mm^2$) | TS ($kg/mm^2$) | El (%) | $\bar{r}$ | n value | ridging index | |
|---|---|---|---|---|---|---|---|---|---|---|---|---|---|
| 9 | Sheet bar caster | 0.8 | 385 | 62 | 650 | unacceptable | 18 | 29 | 46 | 1.25 | 0.220 | 1 | * |
| " | " | 0.8 | 1,102 | 70 | 665 | acceptable | 17 | 30 | 51 | 1.65 | 0.285 | 1 | |
| " | " | 0.8 | 682 | 56 | 950 | acceptable | 17 | 30 | 42 | 0.86 | 0.208 | 5 | * |

Note
*: Comparative example,
no mark: acceptable example

As seen from Table 11, the steel sheets according to the invention show excellent $\bar{r}$-value and ridging resistance, and have a high n-value of not less than 0.23.

EXAMPLE 3

Each of steels having a chemical composition as shown in the following Table 12 was shaped into a sheet bar of 20–40 mm in thickness of a method shown in the following Table 13, which was then shaped into a thin steel sheet of 0.8–1.2 mm in thickness by means of a rolling machine of 6 stands. In this case, the high strain rate rolling was carried out at the final stand.

The thus obtained thin steel sheet was subjected to pickling and skin-pass rolling (draft: 0.5–1%) to obtain properties as shown in Table 13.

TABLE 12

| Steel | C | Si | Mn | P | S | N | Al | Others |
|---|---|---|---|---|---|---|---|---|
| 10 | 0.02 | 0.02 | 0.29 | 0.011 | 0.011 | 0.0038 | 0.047 | — |
| 11 | 0.002 | 0.01 | 0.18 | 0.009 | 0.007 | 0.0029 | 0.028 | Ti: 0.029 |
| 12 | 0.003 | 0.01 | 0.16 | 0.007 | 0.008 | 0.0022 | 0.029 | Nb: 0.015 |
| 13 | 0.002 | 0.02 | 0.20 | 0.008 | 0.007 | 0.0025 | 0.027 | Ti: 0.020<br>Nb: 0.006 |

TABLE 13

| Steel | Production of sheet bar | Thickness (mm) | Rolling conditions: number of stands | strain rate ($sec^{-1}$) | draft (%) | $\epsilon/\mu$ | final temperature (°C.) | Properties: YS ($kg/mm^2$) | TS ($kg/mm^2$) | El (%) | $\bar{r}$ | ΔEl | Δr | ridging index | |
|---|---|---|---|---|---|---|---|---|---|---|---|---|---|---|---|
| 10 | Rough rolling | 1.2 | 6 | 435 | 37 | 1,409 | 650 | 22 | 34 | 43 | 1.31 | 3.4 | 0.23 | 1 | |
| " | Sheet bar caster | 1.0 | 6 | 564 | 36 | 881 | 718 | 21 | 33 | 44 | 1.25 | 8.2 | 0.96 | 1 | * |
| 11 | " | 0.8 | 6 | 519 | 39 | 2,595 | 685 | 18 | 29 | 51 | 1.47 | 3.4 | 0.26 | 1 | |
| " | Rough rolling | 1.2 | 6 | 1,118 | 43 | 5,590 | 925 | 16 | 29 | 52 | 1.02 | 7.3 | 0.89 | 4 | * |
| 12 | " | 1.0 | 6 | 986 | 61 | 4,930 | 582 | 17 | 28 | 52 | 1.53 | 1.5 | 0.14 | 1 | |
| " | Sheet bar caster | 1.2 | 6 | 253 | 53 | 1,687 | 619 | 18 | 30 | 48 | 1.08 | 8.4 | 0.93 | 5 | * |
| 13 | " | 0.8 | 6 | 755 | 26 | 2,518 | 720 | 18 | 31 | 47 | 1.03 | 7.9 | 0.88 | 5 | * |
| " | Rough rolling | 1.0 | 6 | 1,046 | 72 | 7,471 | 553 | 17 | 30 | 51 | 1.65 | 2.1 | 0.12 | | |

Note
*Comparative example,
no mark: acceptable example

As seen from Table 13, the planar anisotropy is small in the steel sheets according to the invention in addition to the excellent $\bar{r}$-value and ridging resistance.

EXAMPLE 4

Each of steels having a chemical composition as shown in the following Table 14 was shaped into a sheet bar of 20–40 mm in thickness by a method shown in the following Table 15, which was then shaped into a thin steel sheet of 0.8–1.2 m in thickness by means of a rolling machine of 6 stands. In this case, a tension was applied between 5 and 6 stands, and the high strain rate rolling was carried out at the final stand. The thus obtained steel sheet was subjected to pickling and skin-pass rolling (draft: 0.5–1%) to obtain properties as shown in Table 15.

TABLE 14

| Steel | C | Si | Mn | P | S | N | Al | Others |
|---|---|---|---|---|---|---|---|---|
| 14 | 0.03 | 0.02 | 0.30 | 0.010 | 0.011 | 0.0034 | 0.046 | B: 0.002 |
| 15 | 0.002 | 0.01 | 0.19 | 0.007 | 0.008 | 0.0022 | 0.028 | Ti: 0.029 |
| 16 | 0.002 | 0.01 | 0.16 | 0.009 | 0.007 | 0.0028 | 0.026 | Nb: 0.015 |
| 17 | 0.001 | 0.02 | 0.18 | 0.008 | 0.007 | 0.0025 | 0.027 | B: 0.001 |
| 18 | 0.002 | 0.01 | 0.15 | 0.009 | 0.006 | 0.0022 | 0.026 | Ti: 0.012<br>Nb: 0.009 |

TABLE 15

| Steel | Production of sheet bar | Thickness (mm) | Rolling conditions: draft (%) | strain rate ($sec^{-1}$) | tension ($kg/mm^2$) | final temperature (°C.) | Properties: YS ($kg/mm^2$) | TS ($kg/mm^2$) | El (%) | $\bar{r}$ | ΔEl | Δr | ridging index | |
|---|---|---|---|---|---|---|---|---|---|---|---|---|---|---|
| 14 | Rough rolling | 1.2 | 37 | 539 | 3.1 | 683 | 22 | 32 | 45 | 1.28 | 3.6 | 0.42 | 1 | |
| " | " | 1.0 | 38 | 612 | 0 | 704 | 21 | 33 | 45 | 1.30 | 8.3 | 0.75 | 1 | * |
| 15 | " | 1.2 | 46 | 986 | 2.9 | 512 | 17 | 29 | 52 | 1.53 | 1.8 | 0.14 | 1 | |
| " | Sheet bar caster | 0.8 | 42 | 851 | 2.9 | 648 | 17 | 28 | 51 | 1.48 | 2.2 | 0.16 | 1 | |
| 16 | " | 1.0 | 36 | 223 | 2.8 | 726 | 18 | 29 | 48 | 0.99 | 7.9 | 0.68 | 5 | * |
| " | Rough rolling | 0.8 | 39 | 435 | 13.0 | 563 | 17 | 28 | 50 | 1.42 | 4.2 | 0.39 | 2 | |
| 17 | " | 1.2 | 69 | 1,298 | 3.0 | 542 | 16 | 29 | 52 | 1.68 | 0.8 | 0.08 | 1 | |
| " | Sheet bar caster | 1.0 | 40 | 613 | 0 | 639 | 17 | 29 | 51 | 1.57 | 7.9 | 0.81 | 1 | * |
| 18 | " | 1.2 | 37 | 788 | 12.8 | 556 | 17 | 29 | 51 | 1.54 | 2.8 | 0.22 | 1 | |

TABLE 15-continued

| Steel | Production of sheet bar | Thickness (mm) | Rolling conditions: draft (%) | strain rate ($sec^{-1}$) | tension ($kg/mm^2$) | final temperature (°C.) | Properties: YS ($kg/mm^2$) | TS ($kg/mm^2$) | El (%) | $\bar{r}$ | ΔEl | Δr | ridging index | |
|---|---|---|---|---|---|---|---|---|---|---|---|---|---|---|
| " | Rough rolling | 1.0 | 22 | 589 | 2.9 | 611 | 16 | 28 | 47 | 0.98 | 7.9 | 0.76 | 5 | * |

Note
*: Comparative example,
no mark: acceptable example

As seen from Table 15, the planar anisotropy is small in the steel sheets according to the invention.

EXAMPLE 5

Each of steels having a chemical composition as shown in the following Table 16 was shaped into a sheet bar of 20–40 mm in thickness by a method shown in the following Table 17, which was then shaped into a thin steel sheet of 0.8–1.6 m in thickness by means of a rolling machine of 6 stands. In this case, the high strain rate rolling was carried out at the final stand, and the coiling temperature was varied within a range of 300°–700° C.

The thus obtained steel sheet was subjected to pickling and skin-pass rolling (draft: 0.5–1%) to obtain properties as shown in Table 17.

TABLE 16

| Steel | C | Si | Mn | P | S | N | Al | Others |
|---|---|---|---|---|---|---|---|---|
| 19 | 0.033 | 0.02 | 0.26 | 0.014 | 0.009 | 0.0043 | 0.043 | — |
| 20 | 0.003 | 0.01 | 0.20 | 0.010 | 0.007 | 0.0025 | 0.029 | Ti: 0.036 |
| 21 | 0.002 | 0.01 | 0.18 | 0.008 | 0.006 | 0.0019 | 0.015 | Nb: 0.010 |
| 22 | 0.004 | 0.02 | 0.15 | 0.011 | 0.008 | 0.0028 | 0.026 | Ti: 0.022<br>Nb: 0.008 |
| 26 | 0.003 | 0.01 | 0.73 | 0.060 | 0.002 | 0.0016 | 0.030 | — |

As apparent from Table 17, the steel sheets according to the invention show excellent $\bar{r}$-value, ridging resistance and phosphate coating property.

EXAMPLE 6

Each of steels having a chemical composition as shown in the following Table 18 was shaped into a sheet bar of 20–40 mm in thickness by a method shown in the following Table 19, which was then shaped into a thin steel sheet of 0.8–1.2 mm in thickness by means of a rolling machine of 6 stands. In this case, $\dot{\epsilon}/R$ was varied by changing a radius of the rolling roll in the final stand, and the high strain rate rolling was carried out at the final stand.

The thus obtained steel sheet was subjected to pickling and skin-pass rolling (draft: 0.5–1%) to obtain properties as shown in Table 19.

TABLE 18

| Steel | C | Si | Mn | P | S | N | Al | Others |
|---|---|---|---|---|---|---|---|---|
| 23 | 0.032 | 0.02 | 0.28 | 0.015 | 0.014 | 0.0050 | 0.042 | — |
| 24 | 0.002 | 0.01 | 0.18 | 0.008 | 0.008 | 0.0022 | 0.028 | Ti: 0.045 |
| 25 | 0.004 | 0.02 | 0.20 | 0.090 | 0.004 | 0.0030 | 0.067 | Nb: 0.020<br>B: 0.0016 |

TABLE 17

| Steel | Production of sheet bar | Thickness (mm) | Rolling conditions: number of stands | strain rate ($sec^{-1}$) | draft (%) | final temperature (°C.) | coiling temperature (°C.) | Properties: YS ($kg/mm^2$) | TS ($kg/mm^2$) | El (%) | $\bar{r}$ | ridging index | phosphate coating property | |
|---|---|---|---|---|---|---|---|---|---|---|---|---|---|---|
| 19 | Rough rolling | 1.2 | 6 | 489 | 36 | 620 | 320 | 22 | 33 | 45 | 1.22 | 1 | 1 | |
| " | " | 1.6 | 6 | 226 | 42 | 698 | 522 | 21 | 34 | 42 | 0.88 | 5 | 5 | * |
| 20 | " | 1.0 | 6 | 1,246 | 38 | 724 | 362 | 16 | 29 | 52 | 1.46 | 1 | 1 | |
| " | Sheet bar caster | 0.8 | 6 | 849 | 40 | 877 | 683 | 17 | 30 | 48 | 0.98 | 4 | 5 | * |
| 21 | " | 1.2 | 6 | 637 | 37 | 637 | 385 | 17 | 29 | 50 | 1.50 | 1 | 2 | |
| " | Rough rolling | 1.0 | 6 | 462 | 39 | 718 | 482 | 18 | 29 | 51 | 1.38 | 1 | 5 | * |
| 22 | " | 1.2 | 6 | 324 | 22 | 620 | 385 | 17 | 30 | 47 | 1.02 | 5 | 4 | * |
| " | Sheet bar caster | 0.8 | 6 | 1,463 | 69 | 538 | 324 | 17 | 30 | 51 | 1.67 | 1 | 1 | |

Note
*: Comparative example,
no mark: acceptable example

TABLE 19

| Steel | Production of sheet bar | Thickness (mm) | Rolling conditions: strain rate ($sec^{-1}$) | draft (%) | $\dot{\epsilon}/R$ | final temperature (°C.) | Properties: YS ($kg/mm^2$) | TS ($kg/mm^2$) | El (%) | TS × El | $\bar{r}$ | ridging index | |
|---|---|---|---|---|---|---|---|---|---|---|---|---|---|
| 23 | Rough rolling | 0.8 | 165 | 35 | 0.55 | 750 | 22 | 31 | 43 | 1,333 | 0.65 | 5 | * |
| " | " | " | 325 | 38 | 1.22 | 760 | 22 | 32 | 45 | 1,440 | 1.18 | 2 | * |
| " | " | " | 755 | 37 | 2.30 | 790 | 19 | 32 | 48 | 1,530 | 1.30 | 1 | |
| " | " | " | 1,515 | 62 | 3.92 | 800 | 20 | 32 | 50 | 1,600 | 1.41 | 1 | |
| 24 | " | 1.0 | 330 | 36 | 0.91 | 570 | 17 | 30 | 46 | 1,380 | 1.26 | 2 | * |
| " | " | " | 685 | 42 | 2.86 | 560 | 17 | 29 | 53 | 1,537 | 1.42 | 1 | |
| " | " | " | 1,822 | 68 | 4.60 | 580 | 18 | 30 | 55 | 1,650 | 1.65 | 1 | |
| 25 | Sheet bar caster | 1.2 | 1,219 | 57 | 3.65 | 820 | 21 | 37 | 42 | 1,554 | 1.58 | 1 | |

TABLE 19-continued

| Steel | Production of sheet bar | Thickness (mm) | Rolling conditions: strain rate ($sec^{-1}$) | draft (%) | $\dot{\epsilon}/R$ | final temperature (°C.) | Properties: YS ($kg/mm^2$) | TS ($kg/mm^2$) | El (%) | TS × El | $\bar{r}$ | ridging index | |
|---|---|---|---|---|---|---|---|---|---|---|---|---|---|
| " | " | " | 725 | 39 | 2.06 | 955 | 22 | 36 | 39 | 1,404 | 0.72 | 5 | * |
| 26 | Rough rolling | " | 1,015 | 49 | 3.25 | 605 | 24 | 42 | 39 | 1,638 | 1.45 | 1 | |

Note
*: Comparative example,
no mark: acceptable example

As apparent from Table 19, the balance of tensile strength and elongation is excellent in addition to the $\bar{r}$-value and ridging resistance.

EXAMPLE 7

Each of steels having a chemical composition as shown in the following Table 20 was shaped into a sheet bar of 20–40 mm in thickness by a method shown in the following Table 21, which was then shaped into a thin steel sheet by means of a rolling machine of 6 stands. In this case, the high strain rate rolling was carried out at the final stand, and then coiled. Thereafter, the thin steel sheet was fed into a continuous hot metal (Zn, Al, Pb) dipping line without pickling, at where the continuous hot dipping was performed while heating to a temperature required for the dipping (for example, about 600° C. for Zn dipping) without recrystallization treatment.

The rolling conditions, the properties after the skin-pass rolling of 0.5–1.2% and the adhesion property are also shown in Table 21. The ridging resistance was evaluated after the removal of the dipped layer by chemical polishing.

TABLE 20

| Steel | C | Si | Mn | P | S | N | Al | Others |
|---|---|---|---|---|---|---|---|---|
| 27 | 0.018 | 0.01 | 0.29 | 0.008 | 0.006 | 0.0028 | 0.036 | — |
| 28 | 0.001 | 0.01 | 0.18 | 0.010 | 0.002 | 0.0016 | 0.025 | — |
| 29 | 0.003 | 0.01 | 0.17 | 0.009 | 0.001 | 0.0026 | 0.041 | Ti: 0.026<br>Nb: 0.009 |

TABLE 21

| Steel | Production of sheet bar | Thickness (mm) | Rolling conditions: strain rate ($sec^{-1}$) | final temperature (°C.) | draft (%) | coiling temperature (° C.) | Kind of dipping | Properties: YS ($kg/mm^2$) | TS ($kg/mm^2$) | El (%) | $\bar{r}$ | ridging index | Adhesion property of dipped layer: bending radius | Erichsen value (mm) | |
|---|---|---|---|---|---|---|---|---|---|---|---|---|---|---|---|
| 27 | Rough rolling | 1.0 | 162 | 525 | 28 | 365 | Zn | 23 | 32 | 42 | 0.85 | 5 | 2T | 8.5 | * |
| " | " | " | 382 | 620 | 45 | 450 | " | 21 | 32 | 45 | 1.10 | 1 | 4T | 6.2 | * |
| " | " | " | 653 | 575 | 55 | 320 | " | 20 | 32 | 46 | 1.41 | 1 | 0T | 9.8 | |
| 28 | " | 0.7 | 1,315 | 750 | 42 | 360 | " | 18 | 30 | 51 | 1.52 | 1 | 0T | 10.3 | |
| " | " | 1.4 | 665 | 910 | 43 | 385 | Al | 19 | 30 | 46 | 0.67 | 4 | 2T | 8.5 | * |
| " | " | 1.0 | 728 | 530 | 73 | 105 | Pb | 17 | 30 | 49 | 1.47 | 1 | 0T | 10.9 | |
| 29 | Sheet bar caster | 0.8 | 550 | 625 | 38 | 265 | Zn | 16 | 28 | 51 | 1.58 | 1 | 0T | 11.2 | |
| " | " | " | 1,436 | 715 | 56 | 380 | Al | 16 | 29 | 52 | 1.69 | 1 | 0T | 10.7 | |

Note
*: Comparative example,
no mark: acceptable example

As seen from Table 21, the thin steel sheets according to the invention exhibit an excellent adhesion property.

EXAMPLE 8

Each of steels having a chemical composition as shown in the following Table 22 was shaped into a sheet bar of 25–40 mm in thickness by a method shown in the following Table 23, which was then shaped into a thin steel sheet of 0.8–1.0 mm in thickness by means of a rolling machine of 6 stands. In this case, the high strain rate and high draft rolling was carried out at the final stand.

The thus obtained thin steel sheet was subjected to pickling and skin-pass rolling (draft: 0.5–1%) to obain properties as shown in Table 23.

TABLE 22

| Steel | C | Si | Mn | P | S | N | Al | Others | Recrystallization temperature (°C.) |
|---|---|---|---|---|---|---|---|---|---|
| 30 | 0.025 | 0.01 | 0.29 | 0.009 | 0.006 | 0.0016 | 0.026 | — | 550 |
| 31 | 0.001 | 0.01 | 0.18 | 0.008 | 0.004 | 0.0022 | 0.042 | — | 510 |
| 32 | 0.002 | 0.01 | 0.17 | 0.006 | 0.001 | 0.0012 | 0.069 | Ti: 0.010 | 460 |

TABLE 23

| Steel | Production of sheet bar | Thickness (mm) | Rolling conditions: strain rate ($sec^{-1}$) | draft (%) | final temperature (°C.) | Properties: YS ($kg/mm^2$) | TS ($kg/mm^2$) | El (%) | $\bar{r}$ | ridging index | |
|---|---|---|---|---|---|---|---|---|---|---|---|
| 30 | Rough rolling | 1.0 | 212 | 26 | 480 | 24 | 32 | 39 | 0.82 | 5 | * |
| " | " | " | 425 | 62 | 680 | 22 | 31 | 43 | 1.22 | 1 | * |
| " | " | " | 562 | 56 | 495 | 20 | 31 | 45 | 1.72 | 1 | |
| " | " | " | 1,215 | 67 | 475 | 19 | 33 | 46 | 1.82 | 1 | |
| " | " | 0.8 | 722 | 40 | 250 | 36 | 46 | 16 | 0.72 | 3 | * |
| 31 | Sheet bar caster | " | 415 | 51 | 600 | 18 | 32 | 46 | 1.56 | 1 | * |
| " | " | " | 738 | 65 | 485 | 17 | 29 | 50 | 1.84 | 1 | |
| " | " | 1.2 | 1,415 | 46 | 380 | 18 | 30 | 51 | 2.10 | 1 | |
| 32 | Rough rolling | " | 585 | 72 | 450 | 17 | 28 | 49 | 1.76 | 1 | |
| " | " | " | 1,310 | 44 | 355 | 18 | 29 | 52 | 1.95 | 1 | |

Note
*Comparative example,
no mark: acceptable example

As seen from Table 23, the steel sheets according to the invention show excellent $\bar{r}$-value and ridging resistance, and are particularly suitable for deep drawing.

EXAMPLE 9

Each of steels having a chemical composition as shown in the following Table 24 was shaped into a sheet bar of 25–40 mm in thickness by a method shown in the following Table 25, which was then shaped into a thin steel sheet of 1.0 mm in thickness by means of a rolling machine of 6 stands. In this case, the high strain rate and high draft rolling was carried out at the final stand.

The thus obtained thin steel sheet was subjected to pickling and skin-pass rolling (draft: 0.5–1%) to obtain properties as shown in Table 25. Moreover, the corrosion resistance (corrosion hole number) was measured with respect to three test specimens in the same manner as previously described.

TABLE 24

| Steel | Fe content (wt %) | Impurities (wt %): C | Mn | P | Al | Ti | Nb | Cu | Cr |
|---|---|---|---|---|---|---|---|---|---|
| 33 | 99.30 | 0.07 | 0.35 | 0.010 | 0.06 | <0.005 | <0.005 | 0.03 | 0.04 |
| 34 | 99.75 | 0.02 | 0.10 | 0.012 | 0.04 | <0.005 | <0.005 | 0.01 | 0.01 |
| 35 | 99.84 | 0.003 | 0.06 | 0.007 | 0.03 | <0.005 | <0.005 | 0.01 | 0.02 |
| 36 | 99.81 | 0.002 | 0.07 | 0.006 | 0.03 | 0.03 | <0.005 | 0.01 | 0.01 |
| 37 | 99.80 | 0.003 | 0.07 | 0.010 | 0.03 | <0.005 | 0.01 | 0.02 | 0.01 |
| 38 | 99.76 | 0.004 | 0.08 | 0.051 | 0.03 | 0.02 | 0.008 | 0.01 | 0.01 |

TABLE 25

| Steel | Production of sheet bar | Final rolling conditions: draft (%) | strain rate ($sec^{-1}$) | final temperature (°C.) | Properties: YS ($kg/mm^2$) | TS ($kg/mm^2$) | El (%) | $\bar{r}$ | ridging index | Corrosion resistance: corrosion hole number ($50 \times 70$ $mm^2$) | |
|---|---|---|---|---|---|---|---|---|---|---|---|
| 33 | Rough rolling | 56 | 420 | 720 | 35 | 42 | 28 | 1.12 | 2 | 15.0 | * |
| 34 | " | 44 | 221 | 780 | 19 | 33 | 40 | 0.82 | 5 | 11.3 | * |
| " | " | 26 | 380 | 800 | 30 | 37 | 36 | 0.91 | 4 | 12.0 | * |
| " | " | 50 | 524 | 780 | 18 | 32 | 46 | 1.30 | 1 | 3.3 | |
| 35 | " | 66 | 670 | 680 | 17 | 30 | 48 | 1.50 | 1 | 1.7 | |
| " | " | 43 | 530 | 930 | 26 | 35 | 38 | 0.70 | 2 | 5.0 | * |
| 36 | Sheet bar caster | 52 | 666 | 570 | 16 | 28 | 51 | 1.63 | 1 | 1.0 | |
| 37 | " | 65 | 712 | 820 | 17 | 30 | 49 | 1.66 | 1 | 0.3 | |
| 38 | Rough rolling | 57 | 530 | 780 | 19 | 33 | 47 | 1.55 | 1 | 2.7 | |

Note
*Comparative example,
no mark: acceptable example

As seen from Table 25, the steel sheets according to the invention show excellent $\bar{r}$-value and ridging resistance as well as good corrosion resistance.

EXAMPLE 10

Each of steels having a chemical composition as shown in the following Table 26 was shaped into a sheet bar of 25–40 mm in thickness by a method shown in the following Table 27, which was then shaped into a thin steel sheet of 0.8–1.2 mm in thickness by means of a rolling machine of 6 stands. In this case, the high strain rate and high draft rolling was carried out at the final stand. Then, the thin steel sheet was coiled at a temperature of 460°–390° C. and held within a temperature range of 460°–200° C. for 0.5 to 60 minutes.

The thus obtained thin steel sheet was subjected to pickling and skin-pass rolling (draft: 0.5–1%) to obtain properties as shown in Table 27.

TABLE 26

| Steel | C | Si | Mn | P | S | N | Al |
|---|---|---|---|---|---|---|---|
| 39 | 0.035 | 0.02 | 0.24 | 0.013 | 0.008 | 0.0037 | 0.045 |
| 40 | 0.003 | 0.01 | 0.19 | 0.010 | 0.006 | 0.0022 | 0.033 |

TABLE 27

| Steel | Productions of sheet bar | Thickness (mm) | Rolling Conditions: draft (%) | strain rate ($sec^{-1}$) | rolling temperature (°C.) | coil holding time (min) | Properties: YS ($kg/mm^2$) | TS ($kg/mm^2$) | El (%) | $\bar{r}$ | ridging index | AI ($kg/mm^2$) | |
|---|---|---|---|---|---|---|---|---|---|---|---|---|---|
| 39 | Rough rolling | 1.2 | 38 | 559 | 620 | 5 | 20 | 34 | 44 | 1.24 | 1 | 2.6 | |
| " | " | 1.0 | 39 | 608 | 640 | 0.5 | 21 | 33 | 45 | 1.26 | 1 | 6.8 | * |
| 40 | " | 0.8 | 46 | 986 | 638 | 20 | 17 | 29 | 51 | 1.58 | 1 | 1.4 | |
| " | Sheet bar caster | 1.0 | 48 | 895 | 669 | 60 | 17 | 28 | 51 | 1.49 | 1 | 1.0 | |
| " | " | " | 43 | 222 | 674 | 13 | 18 | 30 | 47 | 0.98 | 5 | 4.5 | * |
| " | " | " | 40 | 659 | 887 | 27 | 18 | 29 | 48 | 0.92 | 5 | 3.8 | * |
| " | " | " | 63 | 1,513 | 639 | 18 | 17 | 29 | 52 | 1.62 | 1 | 1.2 | |

Note
*Comparative example,
no mark: acceptable example

As seen from Table 27, in the steel sheets according to the invention, the aging resistance is improved in addition to excellent $\bar{r}$-value and ridging resistance.

EXAMPLE 11

Each of steels having a chemical composition as shown in the following Table 28 was shaped into a sheet bar of 25–30 mm in thickness by a method shown in the following Table 29, which was then shaped into a thin steel sheet of 0.8–1.6 mm in thickness by means of a rolling machine of 6 stands. In this case, the high strain rate rolling was carried out at the final stand. The temperature of the thin steel sheet was held above 500° C. in a water cooling apparatus located just after the final stand for 0.1–5 seconds. Thereafter, the thin steel sheet was coiled, stored and subjected to a skin-pass rolling (draft: 0.5–1%) to obtain properties as shown in Table 29.

TABLE 28

| Steel | C | Si | Mn | P | S | N | Al | Others |
|---|---|---|---|---|---|---|---|---|
| 41 | 0.026 | 0.02 | 0.26 | 0.013 | 0.008 | 0.0028 | 0.045 | |
| 42 | 0.005 | 0.01 | 0.45 | 0.086 | 0.007 | 0.0018 | 0.032 | |
| 43 | 0.001 | 0.01 | 0.18 | 0.009 | 0.002 | 0.0040 | 0.065 | Ti: 0.026 |
| 44 | 0.003 | 0.01 | 0.19 | 0.011 | 0.005 | 0.0012 | 0.008 | Ti: 0.015<br>Nb: 0.010 |

As seen from Table 29, the steel sheets according to the invention show excellent $\bar{r}$-value and ridging resistance as well as low yield ratio.

EXAMPLE 12

Each of steels having a chemical composition as shown in the following Table 30 was shaped into a sheet bar of 25–35 mm in thickness by the conventional rough rolling process or sheet bar caster process, which was then shaped into a thin steel sheet by means of a rolling machine of 6 stands. In this case, the high strain rate rolling was carried out at the final stand. Thereafter, the thin steel sheet was continuously subjected to a metal (Zn, Zn-Fe, Zn-Ni) electroplating in a continuous electroplating line without pickling.

The rolling conditions, the properties after the skin-pass rolling of 0.5–1.2% and the adhesion property are shown in the following Table 31.

TABLE 30

| Steel | C | Si | Mn | P | S | N | Al | Others |
|---|---|---|---|---|---|---|---|---|
| 45 | 0.021 | 0.02 | 0.34 | 0.012 | 0.008 | 0.0046 | 0.044 | — |
| 46 | 0.002 | 0.01 | 0.19 | 0.009 | 0.002 | 0.0022 | 0.022 | Ti: 0.031 |
| 47 | 0.003 | 0.02 | 0.16 | 0.008 | 0.005 | 0.0029 | 0.032 | Nb: 0.012 |

TABLE 29

| Steel | Production of sheet bar | Thickness (mm) | Rolling conditions: heat holding time above 500° C. (sec) | strain rate ($sec^{-1}$) | draft (%) | final temperature (°C.) | Properties: YS ($kg/mm^2$) | TS ($kg/mm^2$) | El (%) | $\bar{r}$ | ridging index | YR (%) | |
|---|---|---|---|---|---|---|---|---|---|---|---|---|---|
| 41 | Rough rolling | 0.8 | 0.12 | 205 | 52 | 670 | 31 | 45 | 29 | 0.76 | 5 | 69 | * |
| " | " | " | 0.10 | 412 | 22 | 720 | 27 | 38 | 34 | 0.86 | 5 | 71 | * |
| " | " | " | 0.32 | 525 | 60 | 700 | 18 | 33 | 43 | 1.24 | 1 | 55 | |
| " | " | " | 1.26 | 1,253 | 51 | 705 | 17 | 33 | 46 | 1.40 | 1 | 52 | |
| " | " | " | 3.85 | 606 | 73 | 650 | 16 | 32 | 45 | 1.32 | 1 | 50 | |
| 42 | " | " | 0.09 | 385 | 46 | 570 | 25 | 40 | 36 | 1.16 | 1 | 63 | * |
| " | " | " | 1.52 | 975 | 56 | 590 | 21 | 41 | 36 | 1.50 | 1 | 51 | |
| " | " | " | 4.66 | 624 | 72 | 565 | 22 | 40 | 37 | 1.38 | 1 | 55 | |
| 43 | Sheet bar caster | 1.6 | 0.14 | 435 | 48 | 930 | 20 | 32 | 46 | 0.89 | 4 | 63 | * |
| " | " | " | 1.76 | 589 | 67 | 815 | 16 | 31 | 48 | 1.56 | 1 | 52 | |
| 44 | Rough rolling | 0.8 | 1.56 | 1,319 | 44 | 680 | 15 | 29 | 52 | 1.65 | 1 | 52 | |
| " | " | " | 4.65 | 650 | 58 | 700 | 15 | 30 | 49 | 1.52 | 1 | 50 | |

Note
*Comparative example,
no mark: acceptable example

TABLE 31

| Steel | Production of sheet bar | Thickness (mm) | Rolling conditions: draft (%) | final temperature (°C.) | strain rate ($sec^{-1}$) | coiling temperature (°C.) | Kind of plating | Properties: YS (kg/mm²) | TS (kg/mm²) | El (%) | $\bar{r}$ | ridging index | Adhesion property of plated layer: bending radius | Erichsen value (mm) | |
|---|---|---|---|---|---|---|---|---|---|---|---|---|---|---|---|
| 45 | Rough rolling | 0.8 | 38 | 743 | 653 | 290 | Zn | 21 | 33 | 44 | 1.23 | 1 | 0 T | 9.8 | |
| " | " | 0.8 | 36 | 684 | 222 | 320 | " | 25 | 33 | 39 | 0.72 | 5 | 2 T | 6.8 | * |
| " | Sheet bar caster | 1.2 | 42 | 544 | 776 | 288 | " | 22 | 34 | 44 | 1.29 | 1 | 0 T | 10.1 | |
| 46 | " | 1.2 | 38 | 712 | 812 | 514 | Zn—Fe | 17 | 29 | 51 | 1.47 | 1 | 4 T | 5.3 | * |
| " | " | 1.0 | 41 | 685 | 903 | 355 | " | 17 | 29 | 50 | 1.52 | 1 | 0 T | 10.3 | |
| " | Rough rolling | 1.0 | 63 | 532 | 1,351 | 295 | Zn | 16 | 29 | 52 | 1.63 | 1 | 0 T | 11.2 | |
| 47 | " | 0.8 | 38 | 545 | 715 | 298 | " | 17 | 29 | 50 | 1.55 | 1 | 0 T | 11.0 | |
| " | " | 0.8 | 21 | 664 | 419 | 305 | " | 19 | 30 | 47 | 1.01 | 5 | 2 T | 7.5 | * |
| " | Sheet bar caster | 1.2 | 45 | 880 | 786 | 652 | Zn—Ni | 18 | 30 | 48 | 0.98 | 4 | 4 T | 5.2 | * |
| " | " | 1.2 | 36 | 713 | 592 | 583 | " | 17 | 29 | 50 | 1.42 | 2 | 4 T | 6.1 | * |

Note
*Comparative example,
no mark: acceptable example

As seen from Table 31, the adhesion property of the plated layer is excellent in the thin steel sheets according to the invention.

EXAMPLE 13

TABLE 32-continued

| Steel | C | Si | Mn | P | S | N | Al | Others |
|---|---|---|---|---|---|---|---|---|
| | | | | | | | | Nb: 0.009 |

TABLE 3

| Steel | Production of sheet bar | Thickness (mm) | Rolling conditions: strain rate ($sec^{-1}$) | draft (%) | final temperature (°C.) | Properties: YS (kg/mm²) | TS (kg/mm²) | El (%) | $\bar{r}$ | ridging index | Young's modulus (kg/mm²) | |
|---|---|---|---|---|---|---|---|---|---|---|---|---|
| 48 | Rough rolling | 1.0 | 514 | 38 | 714 | 20 | 34 | 43 | 1.12 | 1 | 21,000 | * |
| " | " | " | 1,633 | 41 | 659 | 21 | 34 | 45 | 1.21 | 1 | 22,500 | |
| 49 | " | " | 1,182 | 56 | 644 | 21 | 34 | 46 | 1.20 | 1 | 22,300 | |
| " | " | 1.2 | 239 | 37 | 592 | 21 | 35 | 40 | 0.92 | 5 | 21,200 | * |
| 50 | " | " | 1,082 | 42 | 532 | 17 | 30 | 50 | 1.57 | 1 | 23,200 | |
| " | " | " | 1,762 | 62 | 706 | 18 | 29 | 52 | 1.41 | 1 | 22,900 | |
| " | Sheet bar caster | 0.8 | 538 | 26 | 712 | 18 | 30 | 47 | 0.99 | 5 | 20,900 | * |
| 51 | " | " | 1,074 | 55 | 563 | 17 | 30 | 51 | 1.62 | 1 | 22,500 | |
| " | " | " | 1,456 | 68 | 633 | 18 | 30 | 52 | 1.56 | 1 | 22,600 | |
| " | Rough rolling | 1.6 | 1,562 | 41 | 542 | 17 | 29 | 52 | 1.55 | 1 | 22,800 | |
| 52 | Rough rolling | 1.6 | 588 | 39 | 782 | 16 | 29 | 50 | 1.31 | 1 | 21,500 | * |
| " | " | 1.2 | 542 | 40 | 916 | 17 | 30 | 47 | 1.02 | 4 | 20,800 | * |
| " | Sheet bar caster | " | 1,105 | 45 | 529 | 17 | 30 | 51 | 1.59 | 1 | 23,300 | |
| 53 | Rough rolling | " | 720 | 39 | 554 | 18 | 30 | 50 | 1.54 | 1 | 22,300 | |
| " | " | 1.0 | 322 | 48 | 733 | 17 | 30 | 48 | 1.22 | 2 | 21,300 | * |
| " | " | " | 1,413 | 72 | 608 | 17 | 29 | 52 | 1.54 | 1 | 22,400 | |

Note
*Comparative example,
no mark: acceptable example

Each of steels having a chemical composition as shown in the following Table 32 was shaped into a sheet bar of 20–40 mm in thickness by a method shown in the following Table 33, which was then shaped into a thin steel sheet of 0.8–1.6 mm in thickness by means of a rolling machine of 6 stands. In this case, the high strain rate rolling was carried out at the final stand.

The thus obtained thn steel sheet was subjected to pickling and skin-pass rolling (draft: 0.5–1%) to obtain properties as shown in Table 33.

TABLE 32

| Steel | C | Si | Mn | P | S | N | Al | Others |
|---|---|---|---|---|---|---|---|---|
| 48 | 0.02 | 0.02 | 0.25 | 0.018 | 0.009 | 0.034 | 0.046 | — |
| 49 | 0.03 | 0.02 | 0.24 | 0.012 | 0.008 | 0.0031 | 0.042 | B: 0.001 |
| 50 | 0.002 | 0.01 | 0.18 | 0.009 | 0.008 | 0.0021 | 0.025 | — |
| 51 | 0.002 | 0.02 | 0.19 | 0.008 | 0.005 | 0.0024 | 0.022 | Nb: 0.016 |
| 52 | 0.001 | 0.01 | 0.12 | 0.009 | 0.002 | 0.0018 | 0.019 | Ti: 0.020 |
| 53 | 0.003 | 0.02 | 0.15 | 0.007 | 0.006 | 0.0025 | 0.024 | Ti: 0.014 |

As seen from Table 33, the steel sheets according to the invention show excellent $\bar{r}$-value, ridging resistance and bulging rigidity, which are equal to those obtained through the conventional cold rolling-recrystallization annealing steps.

As mentioned above, according to the invention, as-rolled thin steel sheets having excellent formability and ridging resistance as well as other good properties can be manufactured by rolling within a temperature range of 500° C. to $Ar_3$ transformation point or 300° C. to less than recrystallization temperature of ferrite at a high draft and a high strain rate without performing the conventional cold rolling and recrystallization annealing steps. Further, sheet bar caster process, strip caster process and the like may be adopted with respect to the manufacture of the rolling steel material. Therefore, the manufacturing steps for the formable thin steel sheet may largely be simplified in the invention.

What is claimed is:

1. A method of manufacturing formable as-rolled thin steel sheets having an improved ridging resistance through a step of rolling a low carbon steel to a given thickness without subsequent cold rolling step, which comprises performing at least one rolling pase within a temperature range of from 500° C. to $Ar_3$ transformation point at a draft of not less than 35% and a strain rate of not less than 300 $sec^{-1}$, including the step, after the thin steel sheet is rolled to a given thickness, of cooling and coiling at a temperature of not more than 400° C.

2. The method according to claim 1, including the additional step after said coiling of subjecting said thin steel sheet to a hot metal dipping treatment.

3. The method according to claim 1, wherein said low carbon steel has an iron content of not less than 99.50% by weight.

4. The method according to claim 1, including a step after said cooling and before said coiling of subjecting said thin steel sheet to a heat treatment at a temperature of not less than 500° C. for not less than 0.2 second.

5. The method according to claim 1, including the additional step after said coiling of subjecting said thin steel sheet to a metal electroplating treatment.

6. A method of manufacturing formable as-rolled thin steel sheets having an improved ridging resistance through a step of rolling a low carbon steel to a given thickness without subsequent cold rolling step, which comprises performing at least one rolling pass within a temperature range of from 500° C. to $Ar_3$ transformation point at a draft of not less than 35% and a strain rate of not less than 300 $sec^{-1}$, including the step after the thin steel sheet is rolled to a given thickness of cooling, coiling and holding at a temperature of 200°–500° C. for at least one minute.

* * * * *